US010220629B2

(12) United States Patent
Takahashi et al.

(10) Patent No.: US 10,220,629 B2
(45) Date of Patent: Mar. 5, 2019

(54) LIQUID CARTRIDGE INCLUDING MOVABLE MEMBER, AND LIQUID-CONSUMING DEVICE USING THE SAME

(71) Applicant: BROTHER KOGYO KABUSHIKI KAISHA, Nagoya-shi, Aichi-ken (JP)

(72) Inventors: Hiroaki Takahashi, Nagoya (JP); Kosuke Nukui, Nagoya (JP); Tetsuro Kobayashi, Nagoya (JP); Akihito Ono, Nagoya (JP); Takahiro Miyao, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/473,719

(22) Filed: Mar. 30, 2017

(65) Prior Publication Data

US 2018/0093482 A1 Apr. 5, 2018

(30) Foreign Application Priority Data

Sep. 30, 2016 (JP) ..... 2016-192766

(51) Int. Cl.
*B41J 2/175* (2006.01)

(52) U.S. Cl.
CPC ..... *B41J 2/17526* (2013.01); *B41J 2/175* (2013.01); *B41J 2/1752* (2013.01); (Continued)

(58) Field of Classification Search
None
See application file for complete search history.

(56) References Cited

U.S. PATENT DOCUMENTS

2009/0219310 A1 9/2009 Kondo
2013/0162734 A1* 6/2013 Norikane ..... B41J 2/1752 347/86
2016/0279953 A1 9/2016 Hirano et al.

FOREIGN PATENT DOCUMENTS

EP 2 653 313 A2 10/2013
EP 2 783 862 A2 10/2014
(Continued)

OTHER PUBLICATIONS

Extended European Search Report issued in related EP Application No. 17163952.9, dated Oct. 10, 2017.

*Primary Examiner* — Erica Lin
(74) *Attorney, Agent, or Firm* — Merchant & Gould P.C.

(57) ABSTRACT

The liquid cartridge includes: a front surface facing in an insertion direction intersecting a gravitational direction; a rear surface spaced apart from the front surface in the insertion direction; an upper surface facing upward; a liquid supply portion disposed at the front surface; an electrical interface disposed at the upper surface; and a movable member including a detection portion. The movable member is movable between a first position and a second position. The movable member at the second position is positioned upstream in the insertion direction relative to the electrical interface. The movable member at the first position has a portion whose widthwise position is coincident with the electrical interface in a widthwise direction orthogonal to the insertion direction and the gravitational direction. The portion of the movable member at the first position is located downstream in the insertion direction or upward relative to the electrical interface.

18 Claims, 15 Drawing Sheets

(52) U.S. Cl.
CPC ..... *B41J 2/17503* (2013.01); *B41J 2/17513* (2013.01); *B41J 2/17553* (2013.01)

(56) References Cited

FOREIGN PATENT DOCUMENTS

| | | | |
|---|---|---|---|
| JP | 2010-228380 | A | 10/2010 |
| JP | 3194162 | | 10/2014 |
| JP | 2015-196273 | | 11/2015 |

* cited by examiner

LIQUID CARTRIDGE INCLUDING MOVABLE MEMBER, AND LIQUID-CONSUMING DEVICE USING THE SAME

CROSS REFERENCE TO RELATED APPLICATION

This application claims priority from Japanese Patent Application No. 2016-192766 filed Sep. 30, 2016. The entire content of the priority application is incorporated herein by reference.

TECHNICAL FIELD

The present disclosure relates to a liquid cartridge storing liquid therein and a liquid-consuming device to which the liquid cartridge is attachable.

BACKGROUND

Conventionally, there has been known an inkjet printing apparatus configured to print images on printing mediums by ejecting ink stored in an ink cartridge through nozzles. Whenever ink stored in an ink cartridge runs out, a new ink cartridge is detachably mounted in such inkjet printing apparatus.

For example, Japanese Patent Application Publication No. 2015-196273 discloses an ink cartridge that is attachable to and detachable from a printer. This ink cartridge includes an IC board that readably stores information on the ink cartridge. This IC board is disposed on an upper surface of a casing of the ink cartridge.

SUMMARY

In this cartridge, an entirety of the IC board is exposed to the outside of the cartridge. Accordingly, the IC board is susceptible to damages or contamination resulting from contact with external members.

In view of the foregoing, it is an object of the present disclosure to provide a liquid cartridge capable of protecting an electrical interface provided for electrical connection with an external device.

In order to attain the above and other objects, the present disclosure provides a liquid cartridge configured to store liquid therein. The liquid cartridge is configured to be inserted into a cartridge mounting portion in an insertion direction intersecting a gravitational direction in an upright posture. The liquid cartridge includes a front surface, a rear surface, an upper surface, a liquid supply portion, an electrical interface and a movable member. The front surface faces in the insertion direction in the upright posture. The rear surface is spaced apart from the front surface in the insertion direction in the upright posture. The upper surface extends between the front surface and the rear surface in the insertion direction in the upright posture, and the upper surface faces upward in the upright posture. The liquid supply portion is disposed at the front surface and is configured to supply the liquid to outside of the liquid cartridge. The electrical interface is disposed at the upper surface and has a width in a widthwise direction orthogonal to the insertion direction and the gravitational direction. The movable member includes a detection portion subject to external detection. The movable member is movable between a first position and a second position, the second position being located upstream in the insertion direction relative to the first position. The movable member at the second position is positioned upstream in the insertion direction relative to the electrical interface. The movable member at the first position has a portion whose widthwise position is coincident with the electrical interface in the widthwise direction. The portion of the movable member at the first position is located downstream in the insertion direction or upward relative to the electrical interface.

According to another aspect, there is provided a liquid-consuming device including: a liquid cartridge configured to store liquid therein, a cartridge mounting portion, and a consuming section. The liquid cartridge is configured to be inserted into the cartridge mounting portion in an insertion direction intersecting a gravitational direction in an upright posture, and is removed from the cartridge mounting portion in a removal direction opposite to the insertion direction. The consuming section is configured to consume the liquid stored in the liquid cartridge when the liquid cartridge is attached to the case of the cartridge mounting portion. The liquid cartridge includes a front surface, a rear surface, an upper surface, a liquid supply portion, an electrical interface and a movable member. The front surface faces in the insertion direction in the upright posture. The rear surface is spaced apart from the front surface in the insertion direction in the upright posture. The upper surface extends between the front surface and the rear surface in the insertion direction in the upright posture, and the upper surface faces upward in the upright posture. The liquid supply portion is disposed at the front surface and is configured to supply the liquid to outside of the liquid cartridge. The electrical interface is disposed at the upper surface and includes an electrode. The electrical interface has a width in a widthwise direction orthogonal to the insertion direction and the gravitational direction. The movable member includes a detection portion subject to external detection. The movable member is movable between a first position and a second position, the second position being located upstream in the insertion direction relative to the first position. The movable member at the second position is positioned upstream in the insertion direction relative to the electrical interface. The movable member at the first position has a portion whose widthwise position is coincident with the electrical interface in the widthwise direction. The portion of the movable member at the first position is located downstream in the insertion direction or upward relative to the electrical interface. The cartridge mounting portion includes a case, a contact, a sensor and an abutment portion. The case defines an inner space for accommodating the liquid cartridge therein. The contact is disposed at the case. The contact is configured to be electrically connected to the electrode of the electrical interface when the liquid cartridge is attached to the case. The sensor includes a light-emitting portion and a light-receiving portion positioned opposite to each other in the widthwise direction. The detection portion of the liquid cartridge attached to the case is configured to be interposed between the light-emitting portion and the light-receiving portion in the widthwise direction. The abutment portion is disposed at the case. The abutment portion is configured to abut on the movable member of the liquid cartridge attached to the case and maintain the movable member at the second position.

DETAILED DESCRIPTION

Figure 1:
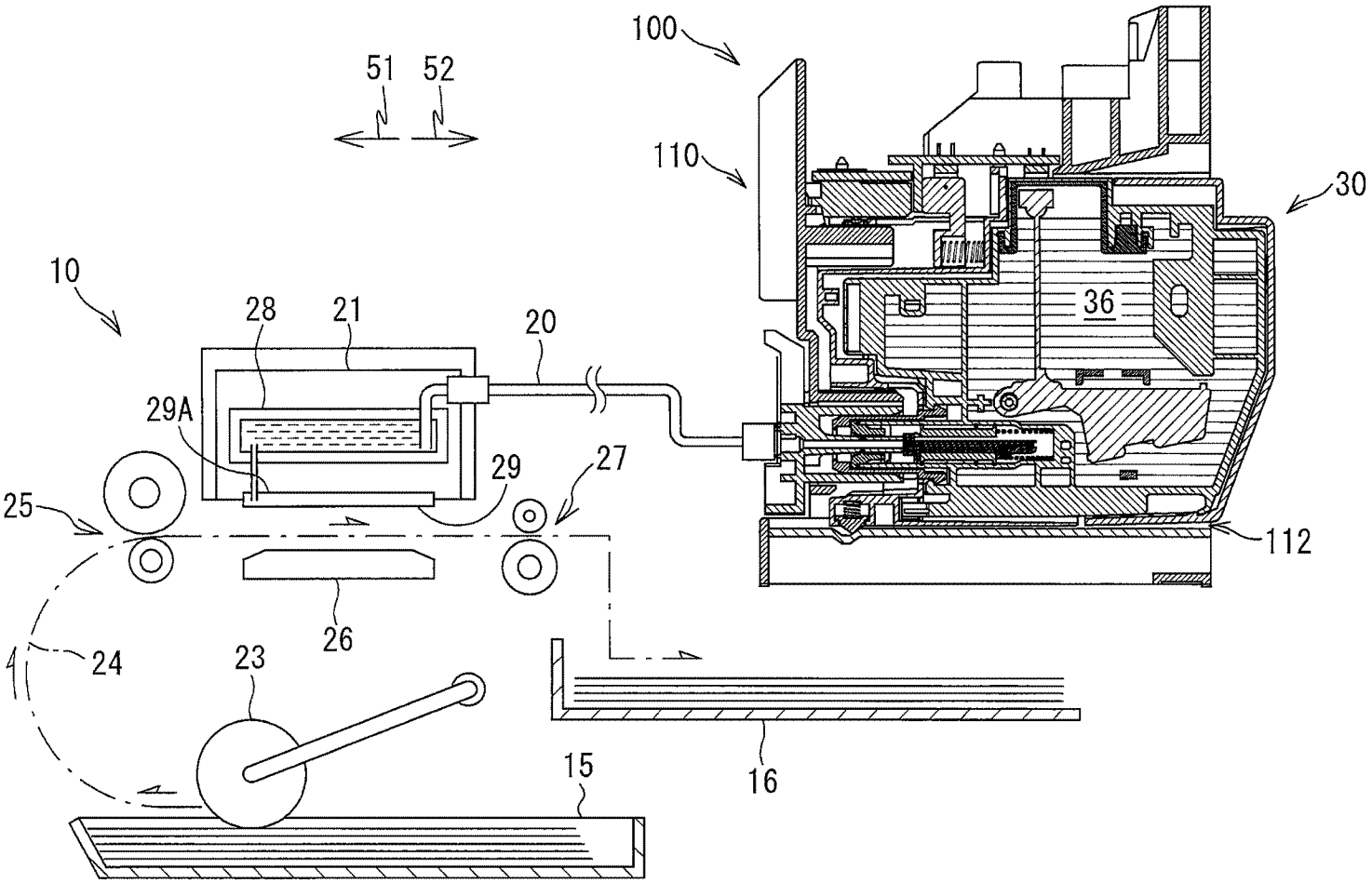
FIG. 1 is a schematic cross-sectional diagram conceptually showing an internal configuration of a printer provided with a cartridge mounting portion configured to detachably accommodate an ink cartridge according to an embodiment of the present disclosure.

Hereinafter, an ink cartridge 30 according to an embodiment of the disclosure will be described in detail while referring to accompanying drawings.

In the following description, a frontward direction 51 is defined as a direction in which the ink cartridge 30 according to the embodiment is inserted into a cartridge mounting portion 110 (or an insertion direction), while a rearward direction 52 is defined as a direction opposite the frontward direction 51, that is, a direction in which the ink cartridge 30 is extracted from the cartridge mounting portion 110 (or a removal direction). The ink cartridge 30 is inserted into and removed from the cartridge mounting portion 110 in an upright posture shown in FIGS. 6 and 7. While the frontward direction 51 and rearward direction 52 are horizontal in the present embodiment, the frontward direction 51 and rearward direction 52 need not be horizontal.

Further, a downward direction 53 is defined as a direction coincident with a gravitational direction, while an upward direction 54 is defined as a direction opposite the downward direction 53. In other words, in the present embodiment, the frontward direction 51 and the rearward direction 52 are defined as a direction intersecting with the gravitational direction. Further, a rightward direction 55 and a leftward direction 56 are defined as directions perpendicular to the frontward direction 51 and the downward direction 53 (gravitational direction). More specifically, in a state where the ink cartridge 30 is mounted in the cartridge mounting portion 110 in the upright posture, and when a user views the ink cartridge 30 from its front side, the rightward direction 55 is a direction toward the right and the leftward direction 56 is a direction toward the left.

Further, in the following description, the frontward direction 51 and the rearward direction 52 may be collectively referred to as a front-rear direction 51 and 52. The upward direction 54 and the downward direction 53 may be collectively referred to as an up-down direction 53 and 54. The rightward direction 55 and the leftward direction 56 may be collectively referred to as a right-left direction 55 and 56 (an example of a widthwise direction).

In this specification, "facing frontward" includes facing in a direction including a frontward component, "facing rearward" includes facing in a direction including a rearward component, "facing downward" includes facing in a direction including a downward component, and "facing upward" includes facing in a direction including an upward component. For example, "a front surface faces frontward" denotes that the front surface may face in a frontward direction, or the front surface may face in a direction inclined relative to the frontward direction.

<Overview of Printer 10>

First, a printer 10 adapted to detachably receive the ink cartridge 30 according to the embodiment will be described with reference to FIG. 1.

The printer 10 is configured to form an image by selectively ejecting ink droplets onto a sheet based on an inkjet recording system. The printer 10 is an example of a liquid-consuming device. As shown in FIG. 1, the printer 10 includes a recording head 21 (as an example of a consuming section), an ink-supplying device 100, and an ink tube 20 connecting the recording head 21 to the ink-supplying device 100. The ink-supplying device 100 includes the cartridge mounting portion 110. The cartridge mounting portion 110 can detachably accommodate the ink cartridge 30 therein. The ink cartridge 30 is an example of a liquid cartridge.

The cartridge mounting portion 110 has a surface formed with an opening 112. The ink cartridge 30 can be inserted in the insertion direction (frontward direction 51) and detached in the removal direction (rearward direction 52) relative to the cartridge mounting portion 110 through the opening 112.

The ink cartridge 30 stores ink therein that the printer 10 can use for printing. The ink cartridge 30 is connected to the recording head 21 through the ink tube 20 when the ink cartridge 30 has been completely mounted in the cartridge mounting portion 110.

The recording head 21 includes a sub tank 28 for temporarily storing ink supplied from the ink cartridge 30 through the ink tube 20. The recording head 21 also includes a plurality of nozzles 29 through which the ink supplied from the sub tank 28 is selectively ejected in accordance with the inkjet recording system. More specifically, the recording head 21 includes a head control board (not shown), and piezoelectric elements 29A each corresponding to one of the nozzles 29. The head control board is configured to selectively apply drive voltages to the piezoelectric elements 29A to eject ink selectively from the nozzles 29. In this way, the recording head 21 is configured to consume the ink stored in the ink cartridge 30 that has been completely mounted in the cartridge mounting portion 110.

The printer 10 also includes a sheet tray 15, a sheet feeding roller 23, a conveying path 24, a pair of conveying rollers 25, a platen 26, a pair of discharge rollers 27, and a sheet discharge tray 16. The sheets from the sheet tray 15 are fed by the sheet feeding roller 23 onto the conveying path 24, and then conveyed by the conveying rollers 25 onto the platen 26. The recording head 21 is configured to selectively eject ink onto the sheets as the sheets move over the platen 26, thereby recording images on the sheets. The sheets that have passed the platen 26 are then discharged by the discharge rollers 27 onto the sheet discharge tray 16 disposed at a downstream end of the conveying path 24.

<Ink-Supplying Device 100>

The ink-supplying device 100 is provided in the printer 10, as shown in FIG. 1. The ink-supplying device 100 functions to supply ink to the recording head 21. As described above, the ink-supplying device 100 includes the cartridge mounting portion 110 for detachably receive the ink cartridge 30 therein. FIG. 1 shows a state where the ink cartridge 30 has been completely received in the cartridge mounting portion 110. In other words, the ink cartridge 30 is in an upright posture in FIG. 1.

<Cartridge Mounting Portion 110>

Figure 2:
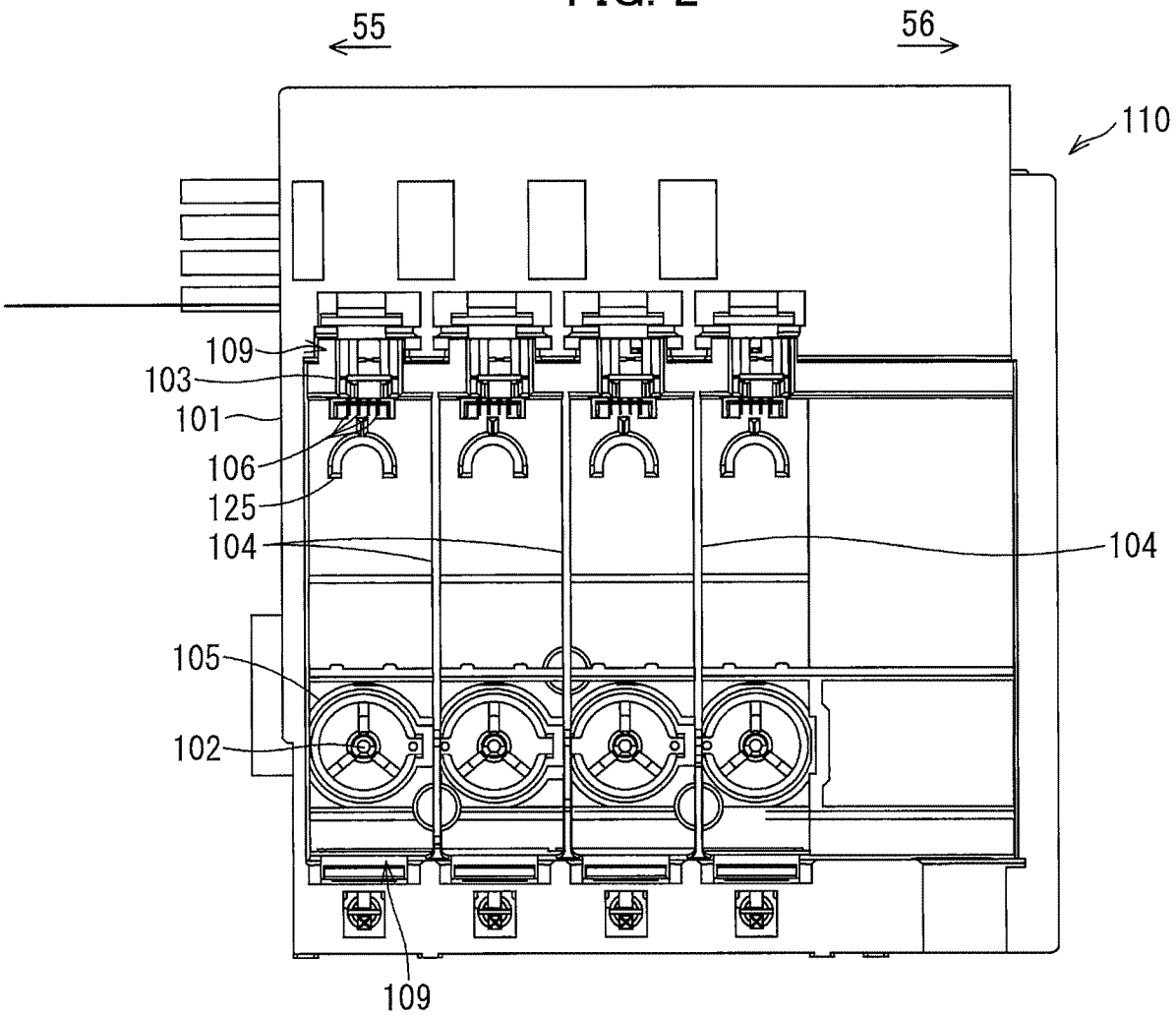
FIG. 2 is a view showing an external appearance of the cartridge mounting portion.
Figure 8:
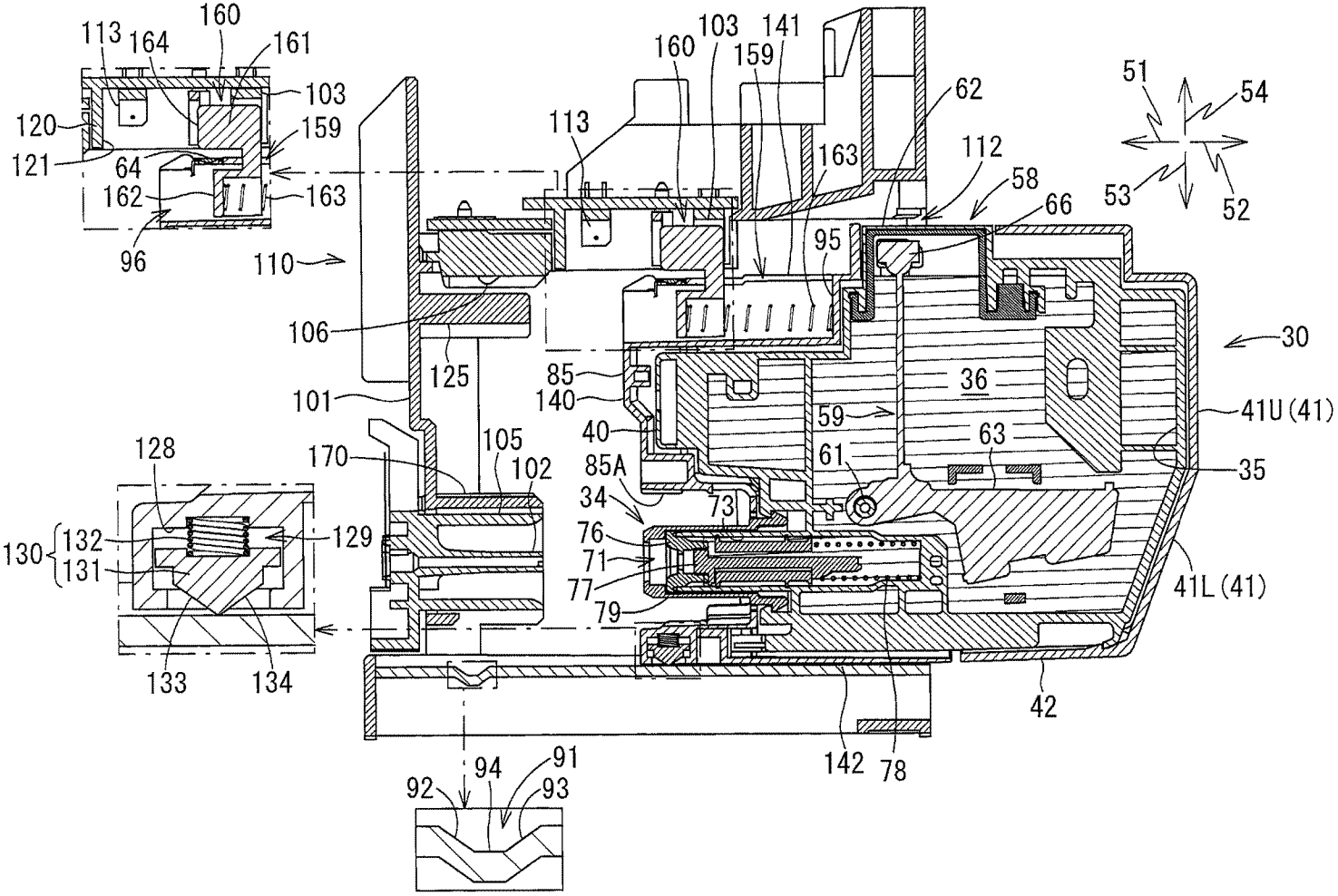
FIG. 8 is a vertical cross-sectional view illustrating the ink cartridge according to the embodiment and the cartridge mounting portion, and illustrating a state where: the ink cartridge is started to be inserted into the cartridge mounting portion; and a movable member is at a first position.

In the ink-supplying device 100, four kinds of ink cartridges 30 corresponding to four colors of cyan, magenta, yellow and black are detachably mountable. Specifically, as shown in FIGS. 2 and 8, the cartridge mounting portion 110 includes a case 101, and four sets of an ink needle 102, an attachment sensor 113, a residual-amount sensor 103 and four contacts 106, each set for each of the four kinds of ink cartridges 30.

The case 101 constitutes a casing of the cartridge mounting portion 110. The case 101 has a box-like shape defining an internal space therein. Specifically, the case 101 includes a top wall defining a ceiling of the internal space, a bottom wall defining a bottom of the internal space, an end wall connecting the top wall and the bottom wall, and the opening 112 positioned opposite the end wall in the front-rear direction 51 and 52.

The opening 112 of the case 101 can be opened and closed by a cover (not illustrated) movably provided at the case 101. When the cover is opened, the opening 112 can be exposed to a surface (user-interface surface) that a user can face when using the printer 10. In the vicinity the opening 112 of the case 101, a cover sensor 118 (see FIG. 3) is provided. The cover sensor 118 can detect whether or not the cover sensor 118 is in abutment with the cover of the case 101. When the cover closes the opening 112, the cover is in contact with the cover sensor 118. The cover sensor 118 thus outputs a detection signal to a controller 1 (described later) of the printer 10. On the other hand, when the cover opens the opening 112 to expose the opening 112, the cover sensor 118 does not output the detection signal since the cover does not contact the cover sensor 118.

The four kinds of ink cartridges 30 can be inserted into and removed from the case 101 through the opening 112. In the case 101, each of the top wall and the bottom wall is formed with four guide grooves 109 for guiding insertion/removal of the ink cartridges 30. Specifically, when the ink cartridge 30 is inserted into and removed from the case 101 through the opening 112, upper and lower ends of the ink cartridge 30 are received in the corresponding upper and lower guide grooves 109 and guided thereby in the front-rear direction 51 and 52, as shown in FIG. 8. Further, the case 101 also includes three plates 104 that partition the internal space into four individual spaces each elongated in the up-down direction 53 and 54. Each of the four kinds of ink cartridges 30 can be mounted in a corresponding one of the four spaces defined by the plates 104.

Hereinafter, for simplifying explanation, only one ink cartridge 30 is assumed to be mounted in the case 101 of the cartridge-receiving section 110.

<Recess 91>

As shown in FIG. 8, a recess 91 is formed in the bottom wall of the case 101 at a position near the end wall constituting the case 101. The recess 91 is recessed downward in the bottom wall of the case 101.

Specifically, referring to FIG. 8, the recess 91 is defined by surfaces 92, 93 and 94. The surface 92 defines a front edge, the surface 93 defines a rear edge, and the surface 94 defines a bottom edge of the recess 91. More specifically, the surface 92 is inclined relative to the front-rear direction 51 and 52 such that: a top edge of the surface 92 is located frontward of a bottom edge of the surface 92; and the surface 92 faces rearward and upward. The surface 93 is inclined relative to the front-rear direction 51 and 52 such that: a top edge of the surface 93 is positioned rearward of a bottom edge of the surface 93; and the surface 93 faces frontward and upward. The surface 94 has a front edge connected to the bottom edge of the surface 92, and a rear edge connected to the bottom edge of the surface 93.

Incidentally, the surfaces 92 and 93 may extend parallel to the up-down direction 53 and 54. Further, the recess 91 may be formed in the bottom wall of the case 101 at a position other than the vicinity of the end wall.

In the state in which the ink cartridge 30 is attached to the cartridge mounting portion 110, an engaging portion 130 (described later) of the ink cartridge 30 is fitted into the recess 91. At this time, the surface 93 of the recess 91 engages with a surface 134 (described later) of the engaging portion 130.

<Ink Needle 102>

The ink needle 102 is formed of a resin and has a generally tubular shape. As shown in FIGS. 2 and 8, the ink needle 102 is disposed on a lower end portion of the end wall constituting the case 101. Specifically, the ink needle 102 is disposed at a position corresponding to an ink supply portion 34 (described later) of the ink cartridge 30 mounted in the cartridge mounting portion 110. The ink needle 102 protrudes rearward from the end wall of the case 101.

A cylindrical-shaped guide portion 105 is provided on the end wall to surround the ink needle 102. The guide portion 105 protrudes rearward from the end wall. The guide portion 105 has a protruding end that is open rearward. Specifically, the ink needle 102 is positioned at a diametrical center of the guide portion 105. The guide portion 105 is shaped to allow the ink supply portion 34 of the mounted ink cartridge 30 to be received in the guide portion 105.

Figure 9:
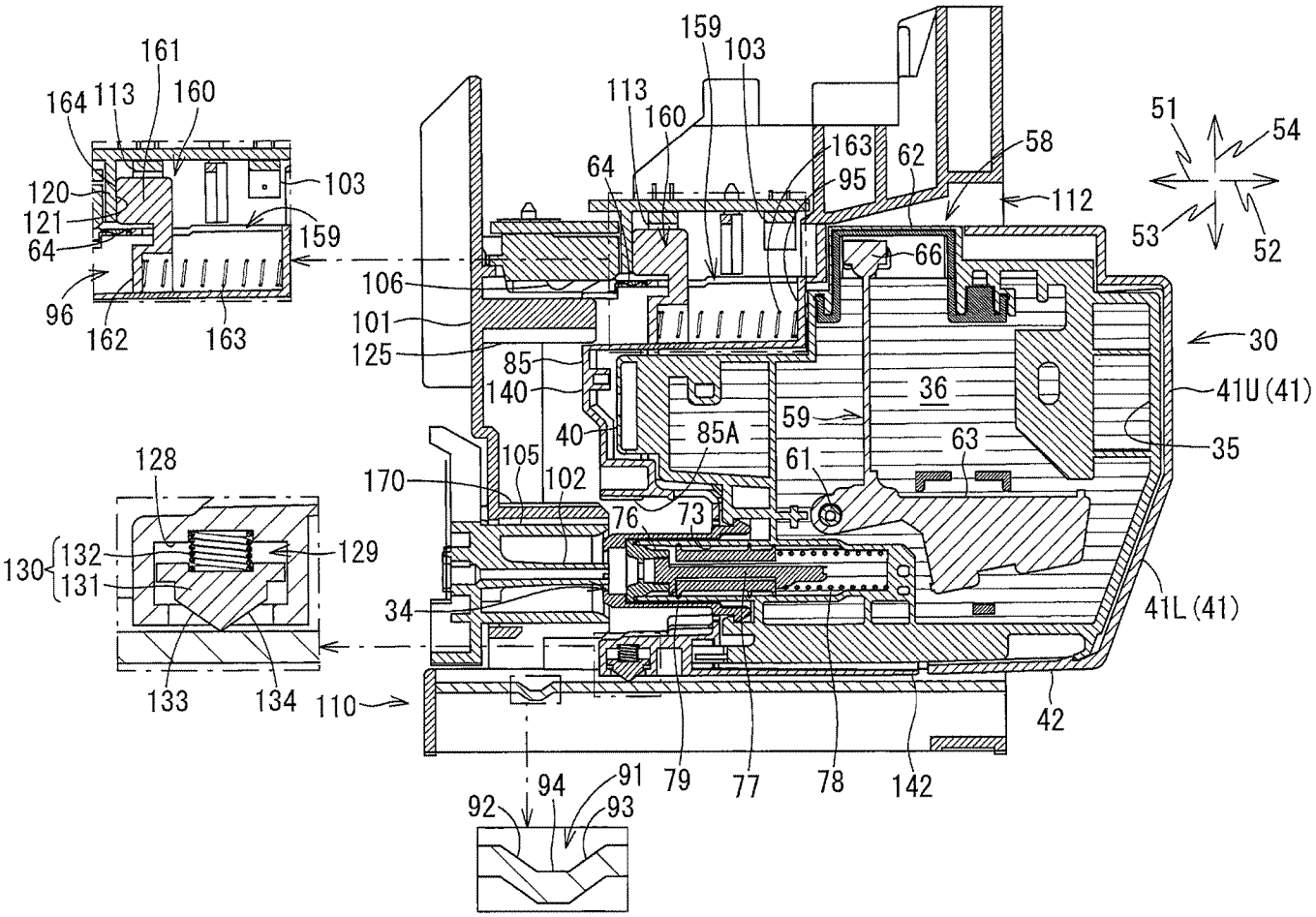
FIG. 9 is a vertical cross-sectional view illustrating the ink cartridge according to the embodiment and the cartridge mounting portion, and illustrating a state where: an ink supply portion of the ink cartridge stars entering into a guide portion of the cartridge mounting portion; a rod of the cartridge mounting portion starts entering into a recessed portion of the ink cartridge; and a front surface of a rib constituting the movable member is in contact with an abutment surface of an abutment portion.

During insertion of the ink cartridge 30 into the cartridge mounting portion 110 in the frontward direction 51, i.e., in the course of action for attaching the ink cartridge 30 to the cartridge mounting portion 110, the ink supply portion 34 of the ink cartridge 30 enters into the guide portion 105 (see FIG. 9). As the ink cartridge 30 is inserted further forward in the frontward direction 51, the ink needle 102 enters into an ink supply port 71 of the ink supply portion 34 (see FIG. 10). The ink needle 102 is thus connected to the ink supply portion 34 to allow communication with each other. Hence, the ink stored in an ink chamber 36 formed in the ink cartridge 30 is allowed to flow into the ink tube 20 connected to the ink needle 102 through an internal space defined in the ink supply portion 34 and an inner space defined in the ink needle 102. Incidentally, the ink needle 102 may have a flat-shaped tip end or a pointed tip end.

<Rod 125>

As illustrated in FIGS. 2 and 8, a rod 125 is provided at the end wall of the case 101 at a position above the ink needle 102. The rod 125 protrudes rearward from the end wall of the case 101. The rod 125 is shaped like an upper half portion of a cylinder. That is, as shown in FIG. 2, the rod 125 has an inverted U-shape in cross-section taken along a plane perpendicular to the front-rear direction 51 and 52. The rod 125 has a rib that protrudes upward from an uppermost portion of the inverted U-shape. The rib extends in the front-rear direction 51 and 52. In a state where the ink cartridge 30 is attached to the cartridge mounting portion 110, that is, when the ink cartridge 30 is in an attached state, the rod 125 is received in a recessed portion 96 (described later) of the attached ink cartridge 30.

<Contacts 106>

Figure 4A:
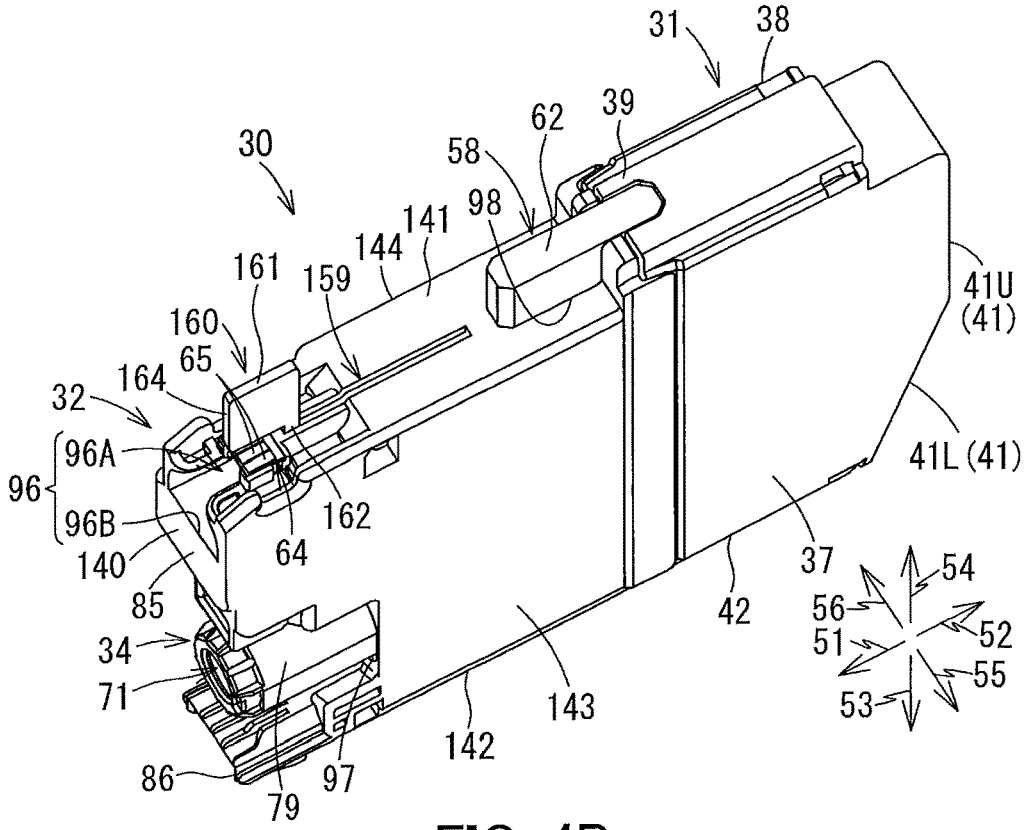
FIG. 4A is a perspective view showing an external appearance of the ink cartridge according to the embodiment in an upright posture when viewed from a perspective frontward and upward of the ink cartridge.
Figure 4B:
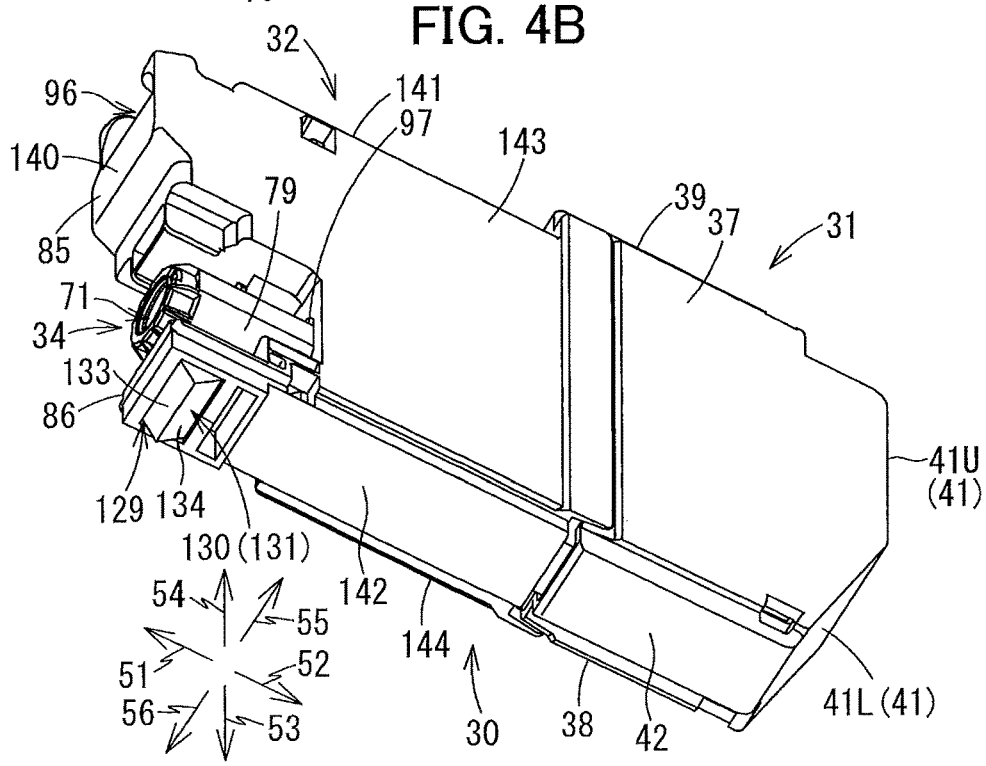
FIG. 4B is a perspective view showing the external appearance of the ink cartridge according to the embodiment in the upright posture when viewed from a perspective frontward and downward of the ink cartridge.
Figure 5A:
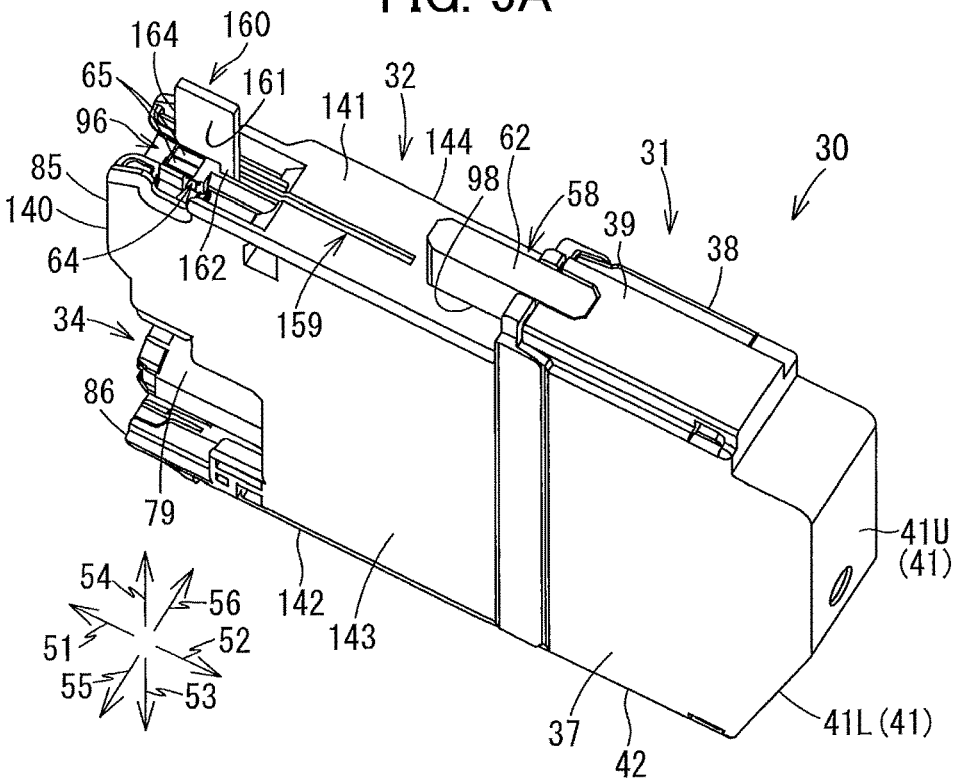
FIG. 5A is a perspective view showing the external appearance of the ink cartridge according to the embodiment in the upright posture when viewed from a perspective rearward and upward of the ink cartridge.
Figure 5B:
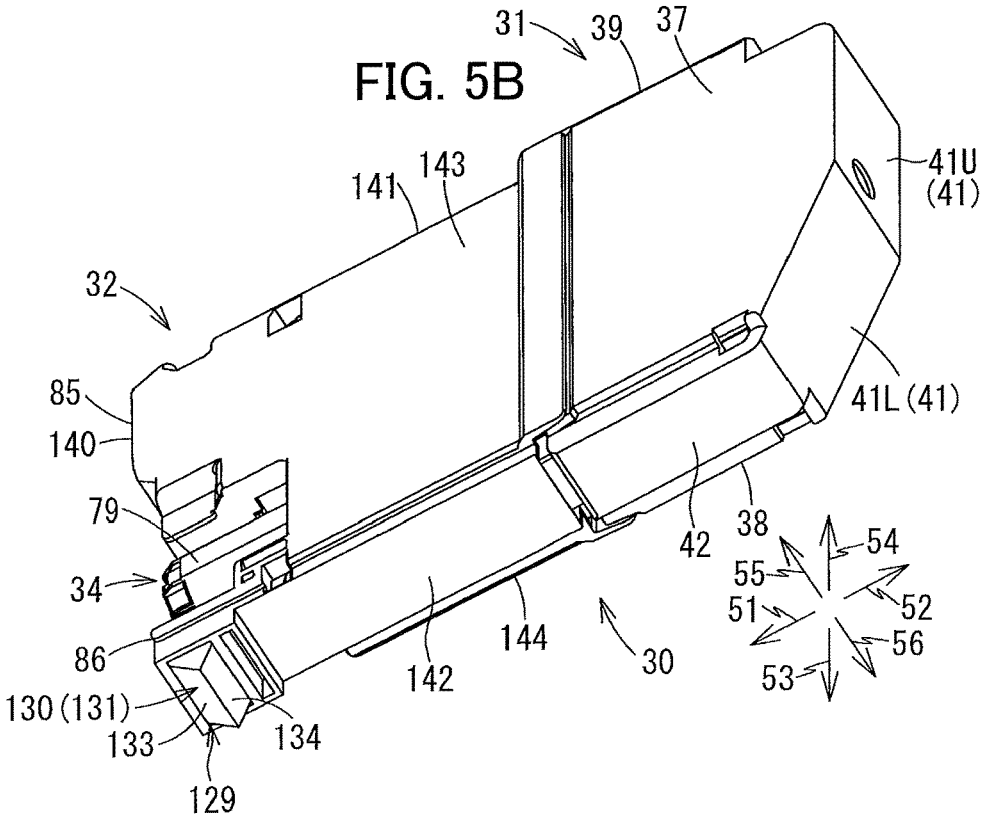
FIG. 5B is a perspective view showing the external appearance of the ink cartridge according to the embodiment in the upright posture when viewed from a perspective rearward and downward of the ink cartridge.

As illustrated in FIGS. 2 and 8, four contacts 106 (as an example of a contact) are disposed on the top wall of the case 101 at positions near the end wall of the case 101. The four contacts 106 protrude from a lower surface of the top wall downward toward the internal space of the case 101. Although not illustrated in detail in the drawings, the four contacts 106 are arranged to be spaced apart from one another in the right-left direction 55 and 56. The four contacts 106 are arranged each at a position corresponding to one of four electrodes 65 of the ink cartridge 30 (see FIGS. 4A and 5A), as will be described later. Each contact 106 is formed of a material having electrical conductivity and resiliency. The contacts 106 are therefore upwardly resiliently deformable.

Note that, in the present embodiment, four sets of the four contacts 106 are disposed each set for each of the four ink cartridges 30 that can be mounted in the case 101. However, the number of contacts 106 and the number of electrodes 65 may be arbitrary.

Figure 3:
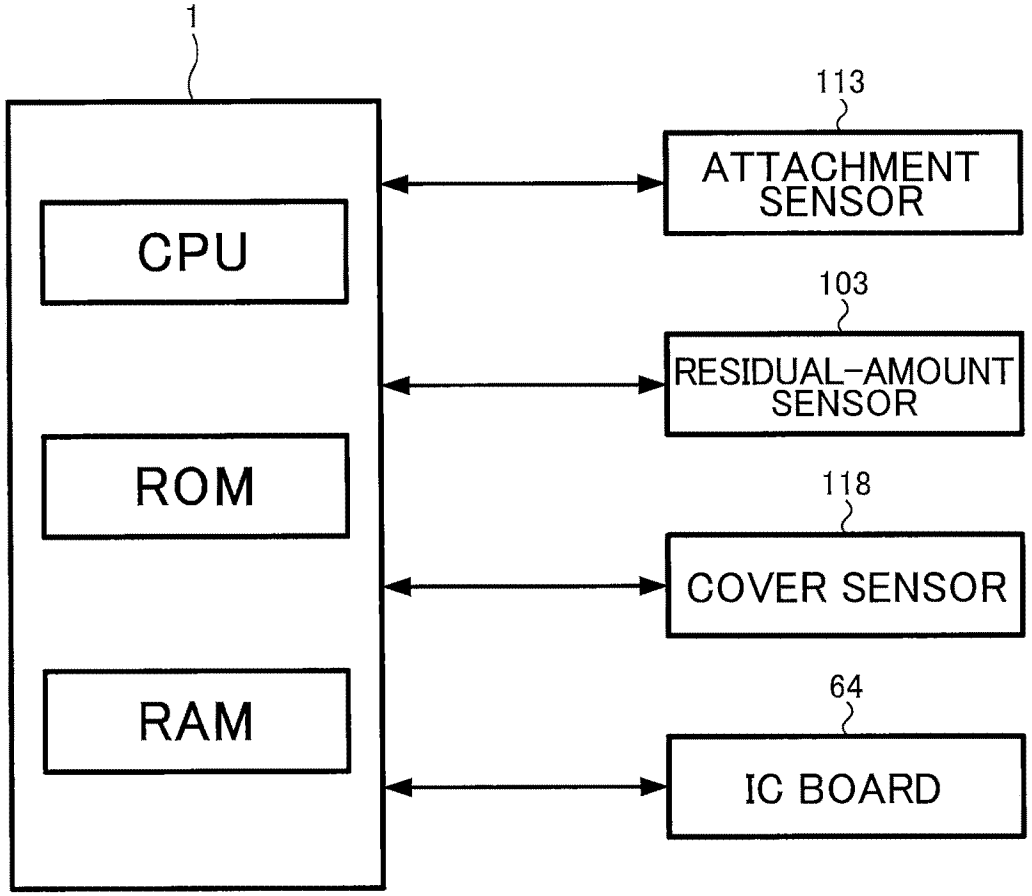
FIG. 3 is a functional block diagram of a controller of the printer.

Each contact 106 is electrically connected to the controller 1 of the printer 10 (see FIG. 3). The contacts 106 are engaged with the corresponding electrodes 65 when the ink cartridge 30 is attached to the case 101. When engaged with the corresponding electrodes 65, the respective contacts 106 are electrically connected to the corresponding electrodes 65, so that: a voltage Vc is applied to the corresponding electrode 65; the corresponding electrode 65 is grounded; and power is supplied to the corresponding electrode 65. Due to establishment of the electrical connection between the contacts 106 and the electrodes 65, the data stored in an IC of the ink cartridge 30 is made electrically accessible. Outputs from the electrical circuits are configured to be inputted into the controller 1 of the printer 10.

<Residual-Amount Sensor 103>

As illustrated in FIG. 8, the residual-amount sensor 103 is disposed at the top wall of the case 101 at a position rearward of the contacts 106. The residual-amount sensor 103 includes a light-emitting portion and a light-receiving portion. The light-emitting portion and the light-receiving portion are arranged to oppose and to be spaced apart from each other in the right-left direction 55 and 56. When the ink cartridge 30 is attached to the cartridge mounting portion 110, a housing 62 (described later) of the ink cartridge 30 is disposed between the light-emitting portion and the light-receiving portion of the residual-amount sensor 103. In other words, the light-emitting portion and the light-receiving portion are arranged to oppose each other with the housing 62 of the attached ink cartridge 30 interposed therebetween.

The light-emitting portion is configured to emit light in the right-left direction 55 and 56, and the light-receiving portion is configured to receive the light emitted from the light-emitting portion. The residual-amount sensor 103 is configured to output different detection signals depending on whether the light emitted from the light-emitting portion is received by the light-receiving portion. For example, the residual-amount sensor 103 outputs a low-level signal (a signal whose level is less than a threshold level) when the light emitted from the light-emitting portion is not received by the light-receiving portion (i.e., when an intensity of the light received at the light-receiving portion is less than a predetermined intensity). On the other hand, the residual-amount sensor 103 outputs a high-level signal (a signal whose level is equal to or greater than the threshold level) when the light emitted from the light-emitting portion is received by the light-receiving portion (i.e., when the intensity of the light received at the light-receiving portion is equal to or greater than the predetermined intensity).

<Attachment Sensor 113>

As illustrated in FIG. 8, the attachment sensor 113 (as an example of a sensor) is also disposed at the top wall of the case 101. Specifically, the attachment sensor 113 is disposed at a position frontward of the residual-amount sensor 103 but rearward of the contacts 106 in the front-rear direction 51 and 52. That is, the contacts 106 are disposed downstream relative to the attachment sensor 113 in the insertion direction (frontward direction 51). The attachment sensor 113 includes a light-emitting portion and a light-receiving portion. The light-emitting portion is arranged to oppose the light-receiving portion and is spaced apart from the light-receiving portion in the right-left direction 55 and 56. When the ink cartridge 30 is attached to the cartridge mounting portion 110, a rib 161 of a movable member 160 (described later) of the attached ink cartridge 30 is located between the light-emitting portion and the light-receiving portion of the attachment sensor 113. In other words, the light-emitting portion and the light-receiving portion are arranged to oppose each other with the rib 161 of the movable member 160 of the mounted ink cartridge 30 interposed therebetween.

The attachment sensor 113 is configured to output different detection signals depending on whether or not light emitted in the right-left direction 55 and 56 from the light-emitting portion is received by the light-receiving portion. For example, the attachment sensor 113 outputs a low-level signal when the light emitted from the light-emitting portion is not received at the light-receiving portion (that is, when an intensity of the light received at the light-receiving portion is less than a predetermined intensity). On the other hand, the attachment sensor 113 outputs a high-level signal when the light emitted from the light-emitting portion is received by the light-receiving portion (that is, when the intensity of the received light is equal to or greater than the predetermined intensity).

<Controller 1>

The printer 10 further includes the controller 1 shown in FIG. 3. The controller 1 is an arithmetic-logic unit (ALU) that may include a CPU, a ROM and a RAM, for example. The controller 1 may be disposed inside a housing of the printer 10 as a control board for controlling the printer 10, or may be provided in the case 101 as a control board separate from such control board for controlling the printer 10. The controller 1 is electrically connected to the attachment sensor 113, the residual-amount sensor 103 and the cover sensor 118 via electrical circuits so as to be capable of transmitting and receiving electrical signals to and from the attachment sensor 113, the residual-amount sensor 103 and the cover sensor 118, respectively. Further, when the ink cartridge 30 is attached to the cartridge mounting portion 110, the controller 1 is electrically connected to an IC board 64 (described later) of the attached ink cartridge 30 via the contacts 106 so as to be capable of transmitting and receiving electrical signals to and from the IC board 64. Although not illustrated in FIG. 3, the controller 1 is also electrically connected to other components such as a motor and a touch panel so as to be capable of transmitting/receiving electrical signals therewith. The ROM stores a program to enable the controller 1 to execute various processing. The CPU performs computation for executing various processing based on the program stored in the ROM. The RAM functions as a memory for temporarily storing various information therein.

<Abutment Portion 120>

As shown in FIG. 8, an abutment portion 120 is provided on the top wall of the case 101 for the corresponding ink cartridge 30. More specifically, the abutment portion 120 protrudes downward from a lower surface of the top wall of the case 101 toward the internal space of the case 101. The abutment portion 120 is positioned rearward relative to the contacts 106. The abutment portion 120 is disposed frontward relative to the attachment sensor 113. That is, the abutment portion 120 (abutment surface 121) is disposed between the contact 106 and the attachment sensor 113 in the front-rear direction 51 and 52.

The abutment portion 120 has an abutment surface 121 that faces rearward in the internal space of the case 101. That is, the abutment surface 121 is a rear surface of the abutment portion 120 that faces upstream in the insertion direction (frontward direction 51). During insertion of the ink cartridge 30 into the cartridge mounting portion 110, the movable member 160 (described later) of the ink cartridge 30 is configured to abut on the abutment surface 121 of the abutment portion 120.

<Ink Cartridge 30>

The ink cartridge 30 shown in FIGS. 4A to 7 is a container configured to store ink therein. The ink cartridge 30 defines an inner space therein serving as the ink chamber 36 configured to store ink (see FIG. 1). The ink chamber 36 is formed by an inner frame 35. The inner frame 35 is a frame accommodated in a rear cover 31 and a front cover 32. That is, the rear cover 31 and front cover 32 constitute an outer shell of the ink cartridge 30.

Incidentally, the ink chamber 36 may be formed by the rear cover 31 and the front cover 32. That is, the ink cartridge 30 may be configured by the rear cover 31 and the front cover 32, without the inner frame 35 accommodated by the rear cover 31 and front cover 32. Alternatively, an ink bag for storing ink may be accommodated in the rear cover 31 and the front cover 32. In this case, the ink bag may have the same function as the inner frame 35.

Figure 6:
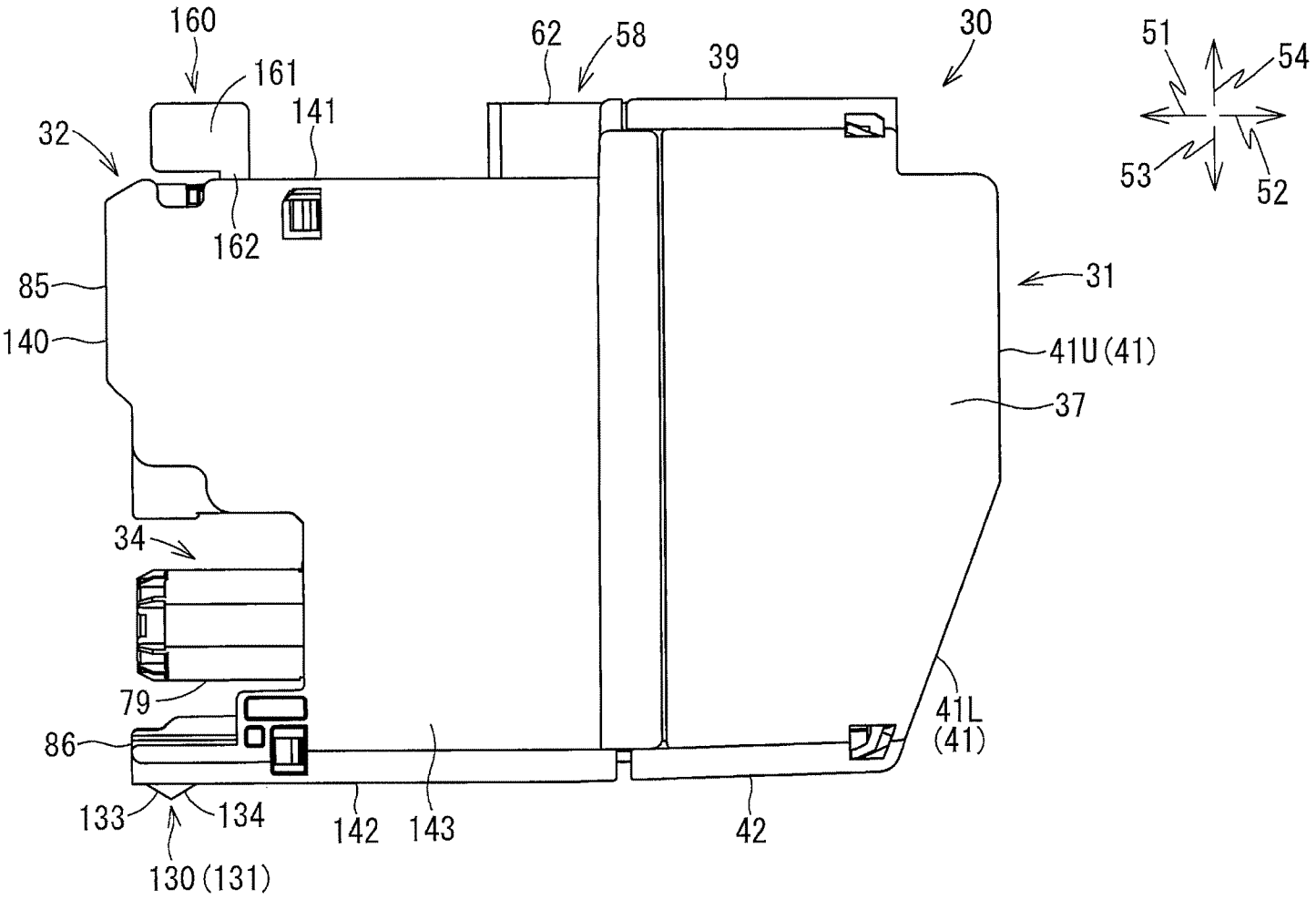
FIG. 6 is a side view of the ink cartridge according to the embodiment in the upright posture.
Figure 7:
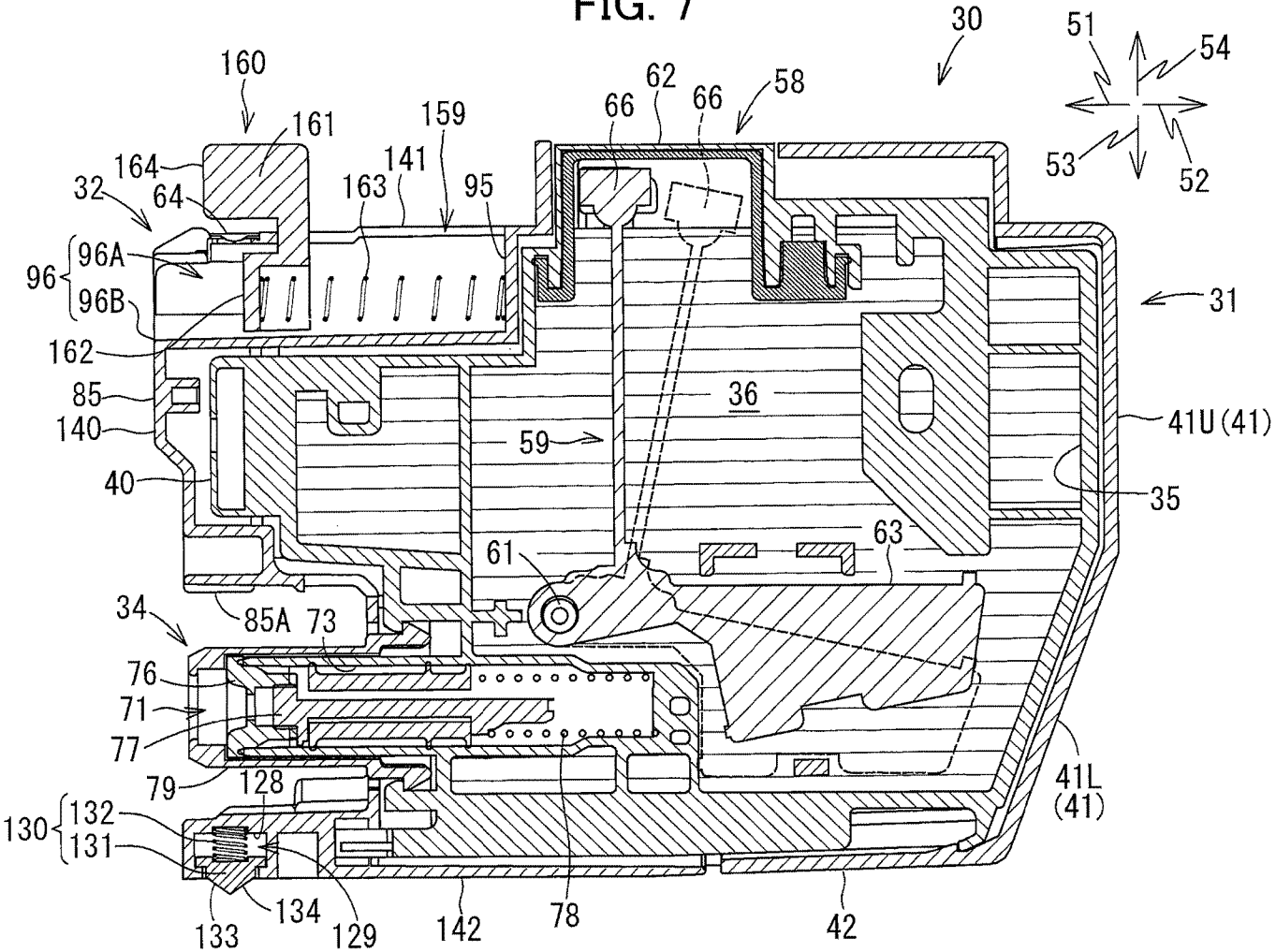
FIG. 7 is a vertical cross-sectional view illustrating an internal configuration of the ink cartridge according to the embodiment.

The posture of the ink cartridge 30 illustrated in FIGS. 6 and 7 is a posture when the ink cartridge 30 is in the attached state (i.e., upright posture). Specifically, as will be described later, the ink cartridge 30 includes a front wall 140, a rear wall 41, top walls 39 and 141, and bottom walls 42 and 142. When the ink cartridge 30 is in the posture shown in FIGS. 6 and 7 (i.e., in the attached state), a direction from the rear wall 41 toward the front wall 140 coincides with the frontward direction 51; a direction from the front wall 140 toward the rear wall 41 coincides with the rearward direction 52; a direction from the top walls 39 and 141 toward the bottom walls 42 and 142 coincides with the downward direction 53, and a direction from the bottom walls 42 and 142 toward the top walls 39 and 141 coincides with the upward direction 54.

In the attached state of the ink cartridge 30, the front wall 140 faces frontward or faces in the frontward direction 51. The rear wall 41 is positioned rearward of and spaced apart from the front wall 140 in the front-rear direction 51 and 52. The top walls 39 and 141 are positioned between the front wall 140 and the rear wall 41. The bottom walls 42 and 142 are positioned below and spaced away from the top walls 39 and 141, respectively. The bottom walls 42 and 142 are positioned between the front wall 140 and the rear wall 41.

When the ink cartridge 30 is attached to the cartridge mounting portion 110, the front wall 140 faces frontward, the rear wall 41 faces rearward, the bottom walls 42 and 142 face downward, and the top walls 39 and 141 face upward. More specifically, in the upright posture of the ink cartridge 30, a front surface of the front wall 140 faces frontward, a rear surface of the rear wall 41 faces rearward, bottom surfaces of the bottom walls 42 and 142 face downward, and top surfaces of the top walls 39 and 141 face upward.

As illustrated in FIGS. 4A to 7, the ink cartridge 30 includes the rear cover 31, the front cover 32, and the inner frame 35 defining the ink chamber 36. The rear cover 31 has a substantially rectangular parallelepiped shape. The front cover 32 has a substantially rectangular parallelepiped shape. The rear cover 31 includes the rear wall 41. The front cover 32 includes the front wall 140. The front cover 32 is assembled to the rear cover 31 to form the outer shell of the ink cartridge 30. The inner frame 35 is accommodated in the rear cover 31 and the front cover 32 assembled to each other.

In the attached state, the ink cartridge 30 extends in the front-rear direction 51 and 52, in the up-down direction 53 and 54, and in the right-left direction 55 and 56. The ink cartridge 30 has a generally flat shape having a height in the up-down direction 53 and 54, a width in the right-left direction 55 and 56, and a depth in the front-rear direction 51 and 52, the width being smaller than the height and the depth. A surface of the front cover 32 facing in an insertion direction (i.e., in the frontward direction 51) when the ink cartridge 30 is inserted into the cartridge mounting portion 110 is the front surface of the front wall 140. A surface of the rear cover 31 facing in a removal direction (i.e., in the rearward direction 52) when the ink cartridge 30 is removed from the cartridge mounting portion 110 is the rear surface of the rear wall 41. That is, the rear wall 41 is disposed to oppose the front wall 140 such that the ink chamber 36 is interposed between the front wall 140 and the rear wall 41.

<Rear Cover 31>

As illustrated in FIGS. 4A to 5B, the rear cover 31 includes the rear wall 41, side walls 37 and 38, a top wall 39, and a bottom wall 42. The side walls 37 and 38 are disposed spaced apart from each other in the right-left direction 55 and 56. The top wall 39 and the bottom wall 42 are disposed spaced apart from each other in the up-down direction 53 and 54, and extend frontward from the rear wall 41. That is, the rear cover 31 has a box-like shape formed with an opening that is open frontward. The inner frame 35 is inserted into the rear cover 31 via this opening. In other words, the rear cover 31 covers a rear portion of the inner frame 35. In a state where the inner frame 35 is inserted in the rear cover 31, the ink chamber 36 is arranged to be interposed between the top wall 39 and the bottom wall 42. In other words, in the upright posture of the ink cartridge 30, the ink chamber 36 is positioned between the front wall 140 (the front surface of the front wall 140) and the rear wall 41 (the rear surface of the rear wall 41).

The rear wall 41 includes an upper portion 41U and a lower portion 41L. The upper portion 41U is arranged above the lower portion 41L. The lower portion 41L is positioned frontward relative to the upper portion 41U. Specifically, the upper portion 41U and the lower portion 41L are both planar shaped, and intersect each other but are not perpendicular to each other. Specifically, the lower portion 41L is inclined relative to the up-down direction 53 and 54 such that the lower portion 41L extends closer to the front wall 140 as extending toward the bottom wall 42. Although not illustrated in the drawings, a sheet prompting a user to push the upper portion 41U is attached to the upper portion 41U. The sheet may include a text such as "PUSH," a sign such as an arrow, or a figure indicating pushing with a finger.

Incidentally, the rear wall 41 may not include the lower portion 41L and may be configured solely of the upper portion 41U. That is, a lower end of the upper portion 41U may be connected to a rear end of the bottom wall 42 of the rear cover 31.

<Front Cover 32>

As illustrated in FIGS. 4A to 5B, the front cover 32 includes the front wall 140, side walls 143 and 144, a top wall 141 and a bottom wall 142. The side walls 143 and 144 are disposed spaced apart from each other in the right-left direction 55 and 56. The top wall 141 and the bottom wall 142 are disposed spaced apart from each other in the up-down direction 53 and 54, and extend rearward from the front wall 140. That is, the front cover 32 has a box shape formed with an opening that is open rearward. The inner frame 35 is inserted into the front cover 32 via the opening. That is, the front cover 32 covers a front portion of the inner frame 35 that is not covered with the rear cover 31.

In a state where the front cover 32 and the rear cover 31 are assembled to each other, that is, in a state where assembly of the ink cartridge 30 is completed, the top wall 141 of the front cover 32 and the top wall 39 of the rear cover 31 constitute a top wall of the ink cartridge 30; the bottom wall 142 of the front cover 32 and the bottom wall 42 of the rear cover 31 constitute a bottom wall of the ink cartridge 30; and the side walls 143 and 144 of the front cover 32 and the side walls 37 and 38 of the rear cover 31 constitute side walls of the ink cartridge 30.

That is, in the assembled ink cartridge 30, a top surface of the top wall 141 and a top surface of the top wall 39 constitute a top surface (upper surface) of the ink cartridge 30; a bottom surface of the bottom wall 142 and a bottom surface of the bottom wall 42 constitute a bottom surface of the ink cartridge 30; and outer surfaces of the side walls 143 and 144 and outer surfaces of the side walls 37 and 38 constitute side surfaces of the ink cartridge 30.

Further, in the state where the ink cartridge 30 is assembled, the front wall 140 of the front cover 32 constitutes a front wall of the ink cartridge 30, whereas the rear wall 41 of the rear cover 31 constitutes a rear wall of the ink cartridge 30. The front wall of the ink cartridge 30 (front wall 140 of the front cover 32) and the rear wall of the ink cartridge 30 (rear wall 41 of the rear cover 31) are arranged spaced apart from each other in the front-rear direction 51 and 52. That is, in the upright posture, the front surface of the front surface 140 constitutes a front surface of the ink cartridge 30; the rear surface of the rear wall 41 constitutes a rear surface of the rear wall of the ink cartridge 30.

Incidentally, the front surface, rear surface, top surface, bottom surface, and side surfaces constituting the ink cartridge 30 need not be configured as one flat plane, respectively. That is, the front surface of the ink cartridge 30 can be any surface(s) that can be seen when the ink cartridge 30 in its upright posture is viewed from its front side, and that is (are) positioned frontward relative to a center of the ink cartridge 30 in the front-rear direction 51 and 52. The rear surface of the ink cartridge 30 can be any surface(s) that can be seen when the ink cartridge 30 in its upright posture is viewed from its rear side, and that is(are) positioned rearward relative to the front-rear center of the ink cartridge 30. The upper surface of the ink cartridge 30 can be any surface(s) that can be seen when the ink cartridge 30 in its upright posture is viewed from above, and that is(are) positioned upward relative to a center of the ink cartridge 30 in the up-down direction 53 and 54. The lower surface of the ink cartridge 30 can be any surface(s) that can be seen when the ink cartridge 30 in its upright posture is viewed from below, and that is positioned downward relative to the center of the ink cartridge 30 in the up-down direction 53 and 54. The same is applied to the side surfaces.

The front wall 140 includes a first protruding portion 85 and a second protruding portion 86. The first protruding portion 85 protrudes frontward from an upper end portion of the front cover 32 to constitute an upper end portion of the front wall 140. The first protruding portion 85 has a front end constituting a part of the front surface of the front wall 140. The second protruding portion 86 protrudes frontward from a lower end portion of the front cover 32 to constitute a lower end portion of the front wall 140. The second protruding portion 86 is positioned below the ink supply portion 34.

The recessed portion 96 is provided at the first protruding portion 85. That is, the recessed portion 96 is arranged at the upper end portion of the front wall 140 of the front cover 32. The recessed portion 96 is recessed rearward relative to the front surface of the front wall 140. The recessed portion 96 is provided below the IC board 64 (described later) that is disposed on the front wall 140. The recessed portion 96 is formed with an opening 96B that is open on the front surface of the front wall 140. That is, the opening 96B faces frontward in the frontward direction 51. The recessed portion 96 defines an internal space 96A therein, and the internal space 96A is communication with the outside of the ink cartridge 30 (ambient air) through the opening 96B. The recessed portion 96 further includes a wall 95 that defines a rear end of the recessed portion 96. During insertion of the ink cartridge 30 into the cartridge mounting portion 110, the rod 125 enters into the internal space 96A via the opening 96B. Accordingly, the recessed portion 96 has a cross-sectional shape in conformance with a cross-sectional shape of the rod 125 taken along a plane perpendicular to the front-rear direction 51 and 52.

A through-hole 97 is formed in a lower end portion of the front wall 140 to penetrate the same in the front-rear direction 51 and 52. When the inner frame 35 is inserted in the front cover 32, the ink supply portion 34 provided at the inner frame 35 is exposed outside through the through-hole 97. Accordingly, the through-hole 97 is formed at a position, with a size and a shape corresponding to those of the ink supply portion 34 of the inner frame 35.

Further, a through-hole 98 is formed in the top wall 141 of the front cover 32. The through-hole 98 penetrates the top wall 141 in the up-down direction 53 and 54. The through-hole 98 serves as a hole for exposing the housing 62 (described later) protruding from an upper wall of the inner frame 35 to the outside when the inner frame 35 is accommodated in the front cover 32. Accordingly, the through-hole 98 is formed in the top wall 141 at a position, with a size and a shape corresponding to those of the housing 62.

On the top wall 141 of the front cover 32, the IC board 64 (an example of an electrical interface) is also disposed. The IC board 64 is positioned above the first protruding portion 85, that is, above the ink supply portion 34. The IC board 64 is a hard plate-shaped rigid board made of glass epoxy. The IC board 64 is electrically connected to the corresponding four contacts 106 (see FIG. 2) arranged in the right-left direction 55 and 56 during insertion of the ink cartridge 30 into the cartridge mounting portion 110, as well as when the ink cartridge 30 is attached to the cartridge mounting portion 110.

An IC (not shown) and the four electrodes 65 are mounted on the IC board 64. The IC is a semiconductor integrated circuit and readably stores data indicating information on the ink cartridge 30, such as a lot number, a production date, and a color of the ink.

The electrodes 65 are electrically connected to the IC. The four electrodes 65 are arranged spaced apart from one another in the right-left direction 55 and 56. Each electrode 65 extends in the front-rear direction 51 and 52. The four electrodes 65 are arranged on an upper surface of the IC board 64 such that the electrodes 65 are exposed above to allow electrically access thereto from above.

<Engaging Portion 130>

As illustrated in FIG. 7, a depression 129 is formed in the bottom wall 142 of the front cover 32 to be recessed upward therefrom. In the depression 129, the engaging portion 130 is disposed. The engaging portion 130 is positioned frontward relative to the housing 62 of a residual-amount detection portion 58 (described later). Note that, if the bottom wall 42 were formed to extend further frontward beyond a light-blocking portion 66 constituting a sensor arm 59 (described later), the depression 129 may be formed in this bottom wall 42, rather than the bottom wall 142.

The engaging portion 130 includes a contact member 131 and a coil spring 132.

The contact member 131 has a surface 133 and a surface 134. The surface 133 is inclined relative to the front-rear direction 51 and 52 such that: an upper edge thereof is positioned frontward relative to a lower edge thereof; and the surface 133 faces frontward and downward. The surface 134 is positioned rearward of the surface 133. The surface 134 is inclined relative to the front-rear direction 51 and 52 such that: an upper edge thereof is positioned rearward of a lower end thereof; and the surface 134 faces rearward and downward.

The coil spring 132 is connected to a ceiling surface 128 defining the depression 129, and the contact member 131. Specifically, the coil spring 132 has an upper end connected to the ceiling surface 128, and a lower end connected to the contact member 131.

With the contact member 131 connected to the coil spring 132, the surfaces 133 and 134 of the contact member 131 can protrude downward relative to the depression 129. That is, the surfaces 133 and 134 protrude downward relative to the bottom wall 142 of the front cover 32 when no external force is applied to the contact member 131.

The surfaces 133 and 134 of the contact member 131 can be received in the depression 129 when the coil spring 132 is compressed. At this time, the coil spring 132 urges the contact member 131 downward. Further, the surfaces 133 and 134 of the contact member 131 are located below the depression 129 when the coil spring 132 has a natural length, as described above. That is, the contact member 131 can move in the up-down direction 53 and 54 by contraction and expansion of the coil spring 132.

<Inner Frame 35>

Although not illustrated in the drawings, the inner frame 35 is formed in a generally annular shape, with a pair of side surfaces in the right-left direction 55 and 56 is opened. as described above. The respective open surfaces of the inner frame 35 are sealed with films (not illustrated) to form the ink chamber 36 for storing ink in the inner frame 35. The inner frame 35 includes a front wall 40 that defines a part of the ink chamber 36. The front wall 40 faces the front wall 140 of the front cover 32 when the inner frame 35 is accommodated in the front cover 32. More specifically, a front surface of the front wall 40 faces a rear surface (opposite the front surface) of the front wall 140 when the inner frame 35 is accommodated in the front cover 32. The ink supply portion 34 is disposed at the front wall 40.

<Ink Supply Portion 34>

As illustrated in FIG. 7, the ink supply portion 34 (as an example of a liquid supply portion) protrudes frontward from the front wall 40 of the inner frame 35. The ink supply portion 34 has a cylindrical outer shape, and protrudes outward through the through-hole 97 formed in the front wall 140 of the front cover 32. That is, the ink supply portion 34 is positioned at the lower end portion of the front wall 140.

The ink supply portion 34 includes a cylindrical-shaped tubular wall 73 defining an internal space therein, a sealing member 76 and a cap 79. The sealing member 76 and cap 79 are attached to the tubular wall 73.

The tubular wall 73 extends to connect the interior and exterior of the ink chamber 36. The tubular wall 73 has a rear end that is opened in the ink chamber 36. The tubular wall 73 has a front end that is opened to the outside of the ink cartridge 30. Accordingly, the tubular wall 73 provides fluid communication between the ink chamber 36 and the outside of the ink cartridge 30 through the internal space of the tubular wall 73. The ink supply portion 34 can thus supply the ink stored in the ink chamber 36 to the outside of the ink cartridge 30 via the internal space of the tubular wall 73. The sealing member 76 and the cap 79 are attached to the front end of the tubular wall 73.

In the internal space of the tubular wall 73, a valve member 77 and a coil spring 78 are accommodated. The valve member 77 and the coil spring 78 serve to selectively switch states of the ink supply portion 34 between a state shown in FIGS. 10 and 11 and a state shown in FIG. 7. That is, in the state shown in FIGS. 10 and 11, the ink is allowed to flow out of the ink chamber 36 to the outside of the ink cartridge 30 via the internal space of the tubular wall 73. In the state shown in FIG. 7, the ink is not allowed to flow out of the internal space of the tubular wall 73 to the outside of the ink cartridge 30.

The valve member 77 is movable in the front-rear direction 51 and 52 to open and close an ink supply port 71 formed at a center of the sealing member 76. The coil spring 78 biases the valve member 77 frontward. Accordingly, without application of any external force, the valve member 77 closes the ink supply port 71 of the sealing member 76.

The sealing member 76 is attached to the front end of the tubular wall 73. The sealing member 76 is formed of an elastic material such as rubber or elastomer. The sealing member 76 is a disc-like shaped and has a center portion in which a through-hole is formed. The through-hole penetrates through the center portion of the sealing member 76 in the front-rear direction 51 and 52 to provide a tubular-shaped inner circumferential surface that defines the ink supply port 71. The ink supply port 71 has a diameter that is slightly smaller than an outer diameter of the ink needle 102. The cap 79 is externally fitted to the tubular wall 73, with the sealing member 76 attached to the front end of the tubular wall 73, such that the sealing member 76 is in liquid-tight contact with the front end of the tubular wall 73.

When the ink cartridge 30 is inserted into the cartridge mounting portion 110 in a state where the valve member 77 closes the ink supply port 71, the ink needle 102 enters into the ink supply port 71. An outer circumferential surface of the ink needle 102 is brought into contact with the inner circumferential surface defining the ink supply port 71 to provide a liquid-tight seal therewith, while elastically deforming the sealing member 76. When the tip of the ink needle 102 moves past the sealing member 76 and enters into the internal space of the tubular wall 73, the ink needle 102 comes in contact with the valve member 77. As the ink cartridge 30 is further inserted into the cartridge mounting portion 110, the ink needle 102 moves the valve member 77 rearward against a biasing force of the coil spring 78, thereby opening the ink supply port 71. Accordingly, the ink stored in the ink chamber 36 can flow into a tip portion of the ink needle 102 via the internal space of the tubular wall 73. Although not illustrated in the drawings, ink flows from the internal space of the tubular wall 73 into the internal space of the ink needle 102 via through-holes formed in the tip portion of the ink needle 102. Accordingly, the ink stored in the ink chamber 36 can flow outside the ink cartridge 30 through the internal space of the tubular wall 73 and through the ink needle 102.

The ink supply portion 34 may not be provided with the valve member 77 for closing the ink supply port 71. Instead, for example, the ink supply port 71 may be closed with a film. In this case, the ink needle 102 may break through the film at the time of insertion of the ink cartridge 30 into the cartridge mounting portion 110, thereby allowing the tip portion of the ink needle 102 to enter inside the internal space of the tubular wall 73 through the ink supply port 71. Still alternatively, the ink supply port 71 may be closed with an elastic force of the sealing member 76 itself. In this case, the ink supply port 71 may be pushed and enlarged by the ink needle 102 only when the ink needle 102 is inserted in the ink supply port 71.

<Residual-Amount Detection Portion 58>

The residual-amount detection portion 58 is configured to change a state of the light emitted from the outside of the ink cartridge 30 (i.e., from the residual-amount sensor 103 of the cartridge mounting portion 110) depending on the states of the ink cartridge 30 (i.e., an amount of residual ink in the ink cartridge 30).

As illustrated in FIG. 7, the residual-amount detection portion 58 includes the housing 62 and the sensor arm 59.

The housing 62 protrudes upward from the upper wall of the inner frame 35. The housing 62 is exposed to the outside through the through-hole 98 formed in the front cover 32 such that the housing 62 protrudes upward relative to the top wall 141 of the front cover 32. The housing 62 defines an internal space therein that is in communication with the ink chamber 36. The housing 62 can allow light to pass therethrough in the right-left direction 55 and 56. That is, the housing 62 has light-transmissive properties.

The sensor arm 59 is disposed in the ink chamber 36 of the inner frame 35. The sensor arm 59 is supported by a pivot shaft 61 extending in the right-left direction 55 and 56. The sensor arm 59 is pivotably movable about the pivot shaft 61. The sensor arm 59 includes a float 63, and the light-blocking portion 66.

The float 63 has a specific gravity smaller than a specific gravity of the ink stored in the ink chamber 36. Accordingly, in the ink chamber 36, buoyancy is generated on the float 63 as long as the float 63 is in the ink. In other words, in a state where the ink chamber 36 is almost filled with the ink, the sensor arm 59 is urged to pivot counterclockwise in FIG. 7 due to the buoyancy generated on the float 63. Hereinafter, the ink chamber 36 is assumed to be filled with ink and the sensor arm 59 is assumed to be in a posture indicated by a sold line in FIG. 7.

The light-blocking portion 66 is plate-shaped. The light-blocking portion 66 is disposed in the housing 62 of the inner frame 35. Specifically, the light-blocking portion 66 is located higher relative to the top wall 141 of the front cover 32. Since the sensor arm 59 is urged to pivot counterclockwise in FIG. 7, the light-blocking portion 66 is in contact with a wall defining a front end of the housing 62. Due to this contact, the sensor arm 59 is maintained in the posture indicated by the solid line shown in FIG. 7. In this state shown in FIG. 7, the light-blocking portion 66 blocks the light of the residual-amount sensor 103 traveling in the right-left direction 55 and 56 through the housing 62. The position of the light-blocking portion 66 at this time is referred to as a detection position (indicated by the solid line in FIG. 7).

More specifically, when the light emitted from the light-emitting portion of the residual-amount sensor 103 is incident on the light-blocking portion 66 before arriving at the light-receiving portion, the intensity of the light received at the light-receiving portion is less than a predetermined intensity, for example, zero. Note that the light-blocking portion 66 may completely block the light traveling in the right-left direction 55 and 56, may partially attenuate the light, may refract the light to change a traveling direction thereof, or may totally reflect the light.

When the amount of ink decreases in the ink chamber 36 and a liquid surface of the ink becomes lower than the position of the float 63 indicated by the solid line in FIG. 7 (i.e., the position of the float 63 when the light-blocking portion 66 is at the detection position), the float 63 starts to move downward, following the declining liquid surface of the ink. In accordance with the downward movement of the float 63, the sensor arm 59 is pivoted clockwise in FIG. 7, thereby moving a part of the light-blocking portion 66 within the housing 62 out of an optical path formed by the light traveling from the light-emitting portion to the light-receiving portion at the residual-amount sensor 103. Accordingly, the intensity of the light received at the light-receiving portion of the residual-amount sensor 103 is equal to or greater than the predetermined intensity. The position of the light-blocking portion 66 at this time (indicated by a broken line in FIG. 7) is a non-detection position that is different from the detection position.

<Movable Member 160>

As shown in FIGS. 4A, 5A, 6 and 7, the ink cartridge 30 further includes the movable member 160. The movable member 160 is positioned frontward relative to a front-rear center of the ink cartridge 30.

Specifically, the movable member 160 extends in the up-down direction 53 and 54 to penetrate the top wall 141 of the front cover 32 through a slot 159 formed in the top wall 141. The slot 159 is formed in the top wall 141 at a position rearward of the IC board 64. The slot 159 is elongated in the front-rear direction 51 and 52. Through the slot 159, the exterior of the ink cartridge 30 and the internal space 96A of the recessed portion 96 are in communication with each other. With this structure, the movable member 160 is movable along the slot 159 in the frontward direction 51 and in the rearward direction 52.

The movable member 160 extends in the up-down direction 53 and 54 through the slot 159. That is, the movable member 160 has a bottom end located in the internal space 96A and an upper end located above the top wall 141 of the front cover 32.

The movable member 160 has a left edge that is located rightward relative to a left edge of the IC board 64. The movable member 160 has a right edge that is located leftward relative to a right edge of the IC board 64. In other words, the movable member 160 is provided between the left and right edges of the IC board 64 in the right-left direction 55 and 56.

The movable member 160 has a width in the right-left direction 55 and 56 that is smaller than a width of the IC board 64 in the right-left direction 55 and 56 in the present embodiment. However, the width of the movable member 160 in the right-left direction 55 and 56 may be larger than the width of the IC board 64 in the front-rear direction 51 and 52.

Specifically, the movable member 160 includes the rib 161 (as an example of a detection portion) and a base portion 162.

The rib 161 constitutes an upper portion of the movable member 160 that is positioned above the top wall 141. That is, the rib 161 protrudes upward relative to the top wall 141. The rib 161 has a plate-like shape having a width in the right-left direction 55 and 56, a length in the front-rear direction 51 and 52, and a height in the up-down direction 53 and 54, the width being smaller than the length and the height. The rib 161 has a front surface 164 which constitutes a front end of the movable member 160. The front surface 164 of the rib 161 is configured to abut on the abutment portion 120 (abutment surface 121) from rearward (see FIGS. 8 and 9). In other words, the front surface 164 of the rib 161 is configured to be applied with an external force. The front surface 164 of the rib 161 is an example of a contact portion.

The base portion 162 extends downward from a bottom surface of the rib 161. The base portion 162 extends into the internal space 96A of the recessed portion 96 through the slot 159.

Further, a coil spring 163 (an example of an urging member) is disposed within the internal space 96A of the recessed portion 96. The coil spring 163 extends in the front-rear direction 51 and 52. The coil spring 163 has a front end connected to the base portion 162, and a rear end connected to the wall 95 constituting the rear end of the recessed portion 96.

Figure 11:
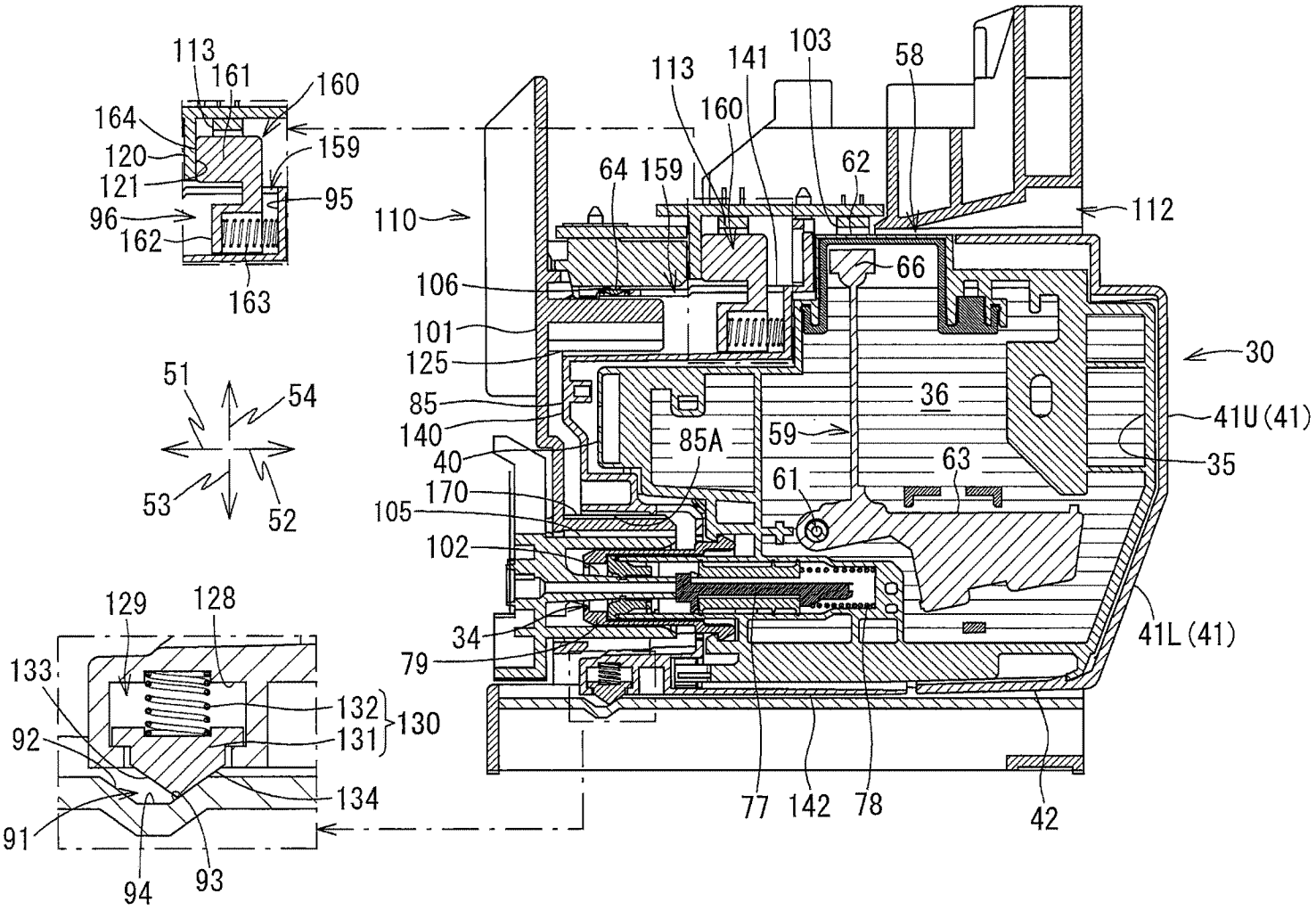
FIG. 11 is a vertical cross-sectional view illustrating the ink cartridge according to the embodiment and the cartridge mounting portion, and illustrating a state where: the ink needle is in the ink supply port of the ink supply portion; the engaging portion is engaged with the recess of the cartridge mounting portion; and the movable member is at the second position.

The movable member 160 is movable in the front-rear direction 51 and 52 between a first position (shown in FIGS. 7 and 8) and a second position (shown in FIG. 11). The second position is positioned rearward relative to the first position. In other word, the second position is located upstream in the insertion direction (frontward direction 51) relative to the first position.

As shown in FIG. 8, the movable member 160 is at the first position when the movable member 160 is not in contact with and separated from the abutment portion 120. At this time, the coil spring 163 has a natural length.

At the first position, the bottom edge of the rib 161 is located above the IC board 64; the front edge of the rib 161 (front surface 164) is located frontward relative to a front edge of the IC board 64; a rear edge of the rib 161 is located rearward relative to a rear edge of the IC board 64; the right edge of the rib 161 is located leftward relative to the right edge of the IC board 64; and the left edge of the rib 161 is located rightward relative to the left edge of the IC board 64. That is, referring to FIG. 14A, the movable member 160 at the first position has a portion (front end portion of the rib 161) that is located frontward relative to the IC board 64. The front end portion of the rib 161 (the portion of the movable member 160 located frontward of the IC board 64) overlaps with the IC board 64 when viewed in the front-rear direction 51 and 52. Put another way, the front end portion of the rib 161 is aligned with the IC board 64 in the front-rear direction 51 and 52. Also, the movable member 160 at the first position has a portion (a center portion of the rib 161) that is located above the IC board 64. This center portion of the rib 161 (the portion upward of the IC board 64) overlaps with the IC board 64 when viewed from above in the up-down direction 53 and 54. That is, the center portion of the rib 161 is aligned with the IC board 64 in the up-down direction 53 and 54.

In other words, in the present embodiment, the movable member 160 at the first position has a portion whose widthwise position is coincident with the IC board 64 in the right-left direction 55 and 56; and the portion of the movable member 160 at the first position is located frontward and upward relative to the IC board 64.

Figure 10:
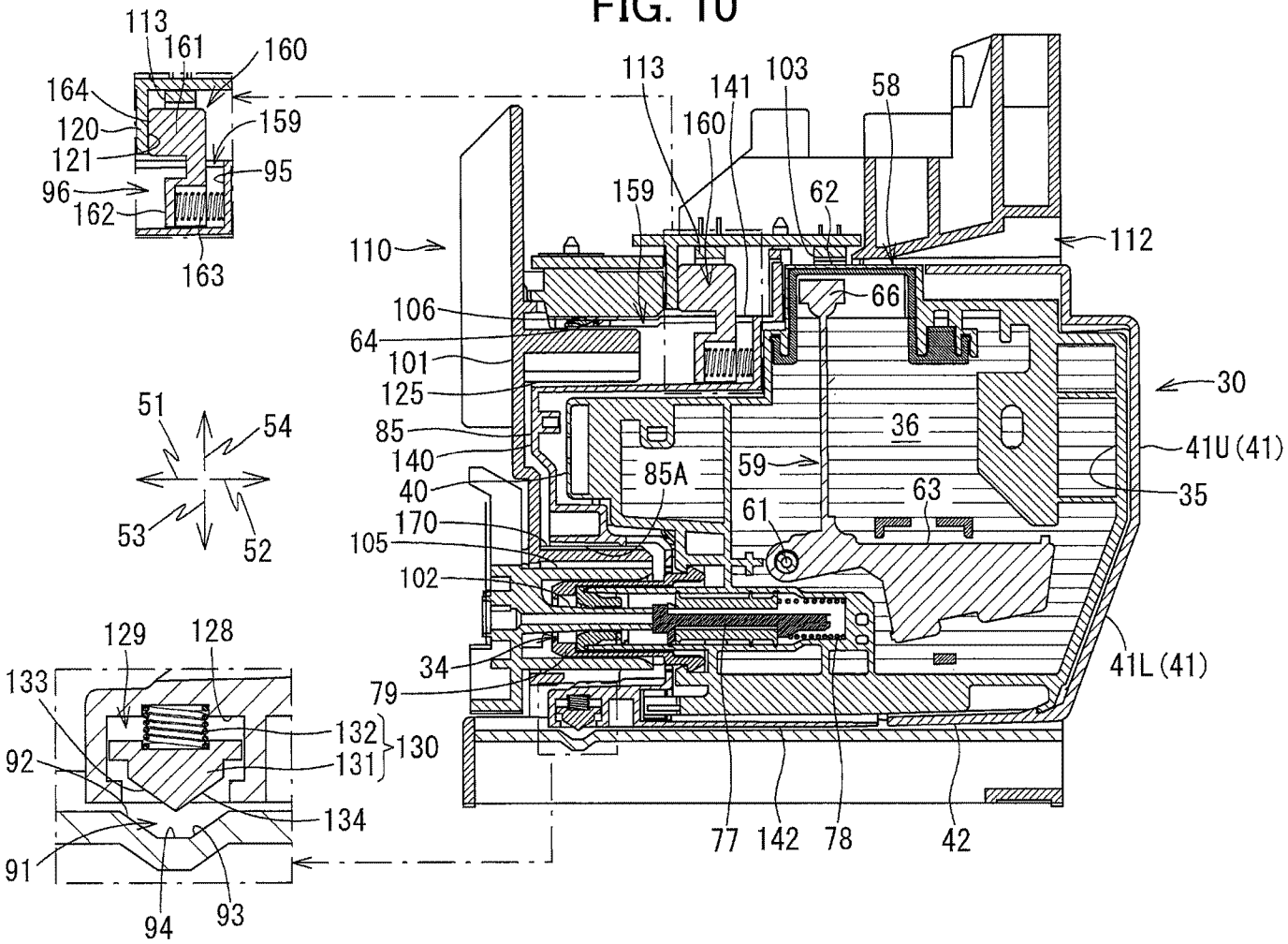
FIG. 10 is a vertical cross-sectional view illustrating the ink cartridge according to the embodiment and the cartridge mounting portion, and illustrating a state where: an ink needle of the cartridge mounting portion has entered an ink supply port of the ink supply portion; an engaging portion of the ink cartridge is located vertically above a recess of the cartridge mounting portion; and the movable member is at a second position.

During insertion of the ink cartridge 30 into the cartridge mounting portion 110, the front surface 164 of the rib 161 is brought into contact with the abutment surface 121 of the abutment portion 120 from its rear side, pushing the abutment surface 121 frontward (see FIGS. 9 and 10). That is, the front surface 164 of the rib 161 is applied with a reaction force acting in the rearward direction 52 from the abutment surface 121 of the abutment portion 120. As a result, the movable member 160 is moved rearward in the rearward direction 52 relative to a main body of the ink cartridge 30 against an urging force of the coil spring 163. Here, the "main body of the ink cartridge 30" refers to the front cover 32, the rear cover 31 and the inner frame 35. That is, the movable member 160 is moved from the first position to the second position relative to the main body of the ink cartridge 30. Put another way, the front surface 164 is applied with an external force (i.e., reaction force from the abutment portion 120 of the cartridge mounting portion 110) during movement of the movable member 160 from the first position to the second position. The movable member 160 is maintained at the second position due to this abutment of the rib 161 on the abutment portion 120.

As shown in FIG. 11, at the second position, the movable member 160 is in abutment with the abutment portion 120 (abutment surface 121). That is, the abutment surface 121 is positioned upward relative to the IC board 64 of the ink cartridge 30 attached to the cartridge mounting portion 110. At this time, the coil spring 163 is compressed to have a smaller front-rear dimension than the coil spring 163 in its natural length. The compressed coil spring 163 urges the movable member 160 frontward. That is, the coil spring 163 urges the movable member 160 toward the first position. However, the movable member 160 is prevented from being moved frontward by the abutment portion 120.

Also, at the second position, the movable member 160 is located rearward relative to the IC board 64.

Further, the movable member 160 at the second position is located between the light-emitting portion and light-receiving portion of the attachment sensor 113. Thus, at the second position, the movable member 160 is configured to block the light of the attachment sensor 113 traveling in the right-left direction 55 and 56. More specifically, when the light emitted from the light-emitting portion of the attachment sensor 113 is incident on the rib 161 before arriving at the light-receiving portion, an intensity of the light received at the light-receiving portion of the attachment sensor 113 is less than a predetermined intensity, for example, zero. Note that the rib 161 may completely block the light traveling in the right-left direction 55 and 56, may partially attenuate the light, may refract the light to change a traveling direction thereof, or may totally reflect the light. In other words, the rib 161 is subject to external light detection.

<Attachment/Detachment of the Ink Cartridge 30 Relative to the Cartridge Mounting Portion 110>

Next, a process for attaching the ink cartridge 30 to the cartridge mounting portion 110 will be described.

Before the ink cartridge 30 is inserted into the cartridge mounting portion 110, the valve member 77 closes off the ink supply port 71 of the sealing member 76. Accordingly, ink flow from the ink chamber 36 to the outside of the ink cartridge 30 is interrupted. Further, the movable member 160 is at the first position. That is, the movable member 160 at the first position is located above and frontward of the IC board 64, and therefore external contact to the IC board 64 from above and frontward is prevented. In this way, the movable member 160 at the first position functions to protect the IC board 64.

Figure 12A:
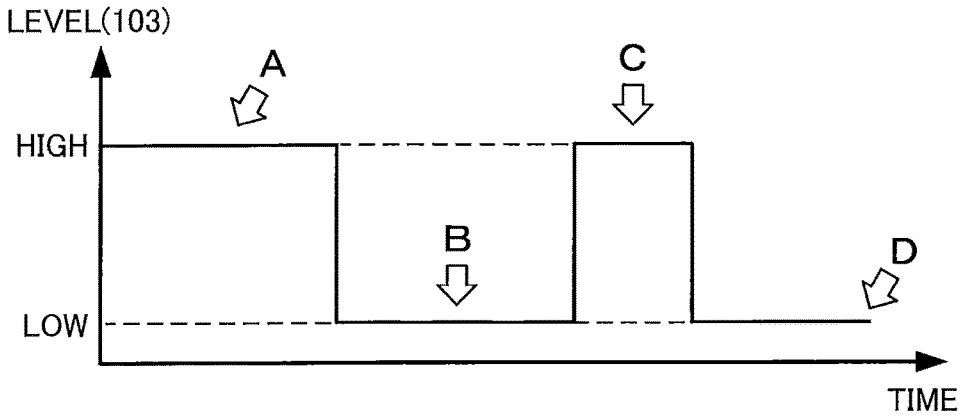
FIG. 12A is a timing chart illustrating changes in signal outputted from a residual-amount sensor during a process in which the ink cartridge according to the embodiment is attached to the cartridge mounting portion.

Also, prior to attachment of the ink cartridge 30 to the cartridge mounting portion 110, nothing is located between the light-emitting portion and the light-receiving portion of the residual-amount sensor 103. The light emitted from the light-emitting portion of the residual-amount sensor 103 is not interrupted. The residual-amount sensor 103 therefore outputs a high-level signal to the controller 1 of the printer 10, as indicated by an arrow "A" in FIG. 12A. Likewise, since nothing is located between the light-emitting portion and the light-receiving portion of the attachment sensor 113, light emitted from the light-emitting portion of the attachment sensor 113 is not interrupted, either. The attachment sensor 113 thus outputs a high-level signal to the controller 1 of the printer 10, as indicated by an arrow "A" in FIG. 12B.

For attaching the ink cartridge 30, the ink cartridge 30 is inserted into the case 101 of the cartridge mounting portion 110 through the opening 112 in the frontward direction 51, as shown in FIG. 8. Since the upper portion 41U of the rear wall 41 of the rear cover 31 is positioned rearward relative to the lower portion 41L of the rear wall 41, that is, since the upper portion 41U is positioned closer to the user than the lower portion 41L is to the user, the user can grip and push the upper portion 41U to insert the ink cartridge 30 frontward into the cartridge mounting portion 110.

As described above, the user is encouraged to push the upper portion 41U, due to the sheet attached to the upper portion 41U for prompting the user to push the upper portion 41U (such as a text such as "PUSH," a sign such as an arrow, or a figure illustrating pushing with a finger). At the time of insertion of the ink cartridge 30 into the case 101 of the cartridge mounting portion 110, a lower portion of the ink cartridge 30, that is, the lower portions of the front cover 32 and the rear cover 31, are inserted into the corresponding lower guide groove 109 formed in the case 101.

Also, upon insertion of the ink cartridge 30 into the case 101 of the cartridge mounting portion 110, the surface 133 of the contact member 131 is brought into contact with a rear end of the bottom wall of the case 101. Accordingly, the surface 133 is pushed upward by the bottom wall constituting the case 101. The contact member 131 is thus moved upward against the biasing force of the coil spring 132 and received in the depression 129. As illustrated in FIG. 8, the contact member 131 is supported from below by the bottom wall of the case 101.

Note that, in the state shown in FIG. 8, the movable member 160 (rib 161) is located between the light-emitting portion and the light-receiving portion of the residual-amount sensor 103. The residual-amount sensor 103 thus outputs a low-level signal, instead of the high-level signal, to the controller 1 of the printer 10. The signal transmitted from the residual-amount sensor 103 to the controller 1 thus changes from high level to low level, as indicated by an arrow "B" in FIG. 12A. At this time, light emitted from the light-emitting portion of the attachment sensor 113 is not yet interrupted. The attachment sensor 113 therefore continues to output the high-level signal to the controller 1 of the printer 10 (the arrow "A" in FIG. 12B). The signal transmitted from the attachment sensor 113 to the controller 1 remains unchanged.

As the ink cartridge 30 is further inserted frontward from the state shown in FIG. 8, the ink cartridge 30 reaches a state shown in FIG. 9. At this time, as illustrated in FIG. 9, the cap 79 of the ink supply portion 34 starts entering inside the guide portion 105. The recessed portion 96 of the front cover 32 faces the rod 125, and the rod 125 starts entering inside the recessed portion 96.

Further, the front surface 164 of the rib 161 of the movable member 160 is brought into contact with the abutment surface 121 of the abutment portion 120 from its rear side, and presses the abutment surface 121. That is, the front surface 164 is applied with a reaction force acting in the rearward direction 52 from the abutment surface 121. As a result, the movable member 160 is moved rearward relative to the main body of the ink cartridge 30 (front cover 32, rear cover 31 and inner frame 35) against the urging force of the coil spring 163. That is, the movable member 160 is moved from the first position toward the second position.

At this time, the movable member 160 (rib 161) is located between the light-emitting portion and the light-receiving portion of the attachment sensor 113. The attachment sensor 113 therefore outputs a low-level signal, instead of the high-level signal, to the controller 1 of the printer 10. That is, the signal outputted from the attachment sensor 113 is changed from high level to low level, as indicated by an arrow "B" of FIG. 12B. Accordingly, the controller 1 of the printer 10 determines that the ink cartridge 30 is mounted in the cartridge mounting portion 110. On the other hand, since nothing is located between the light-emitting portion and the light-receiving portion of the residual-amount sensor 103 at this time, the signal outputted from the residual-amount sensor 103 changes from the low-level to the high-level, as indicated by an arrow "C" of FIG. 12A.

When the ink cartridge 30 is further inserted frontward from the state shown in FIG. 9, the ink cartridge 30 reaches a state shown in FIG. 10. As shown in FIG. 10, the cap 79 of the ink supply portion 34 has entered in the guide portion 105 and the ink needle 102 moves past the ink supply port 71 to separate the valve member 77 from the sealing member 76 against the biasing force of the coil spring 78. The ink cartridge 30 is thus applied with the biasing force of the coil spring 78, by which biasing force the ink cartridge 30 is urged rearward.

Further, in the state shown in FIG. 10, a bottom surface 85A of the first protruding portion 85 facing downward is supported by a surface 170 constituting the case 101 of the cartridge mounting portion 110, the surface 170 facing upward and being positioned above the guide portion 105. Due to the contact between the bottom surface 85A and the surface 170, the ink cartridge 30 is fixed in position in the up-down direction 53 and 54. Incidentally, the bottom surface 85A is arranged to overlap with the IC board 64 when the ink cartridge 30 is viewed from above. That is, the bottom surface 85A has a portion aligned with the IC board 64 in the up-down direction 53 and 54. Alternatively, instead of the surface 170, the rod 125 may function to support the attached ink cartridge 30 to provide positioning of the ink cartridge 30 in the up-down direction 53 and 54, for example.

Further, as shown in FIG. 10, the rod 125 is located inside the recessed portion 96 (in the internal space 96A) of the front cover 32, thereby supporting the front cover 32 from below. The IC board 64 has reached below the corresponding contacts 106, and the electrodes 65 are electrically connected to the contacts 106 while resiliently deforming the contacts 106 upward. At this time, the IC board 64 is urged downward by the resiliently deformed contacts 106. However, at the same time, the rod 125 supports the front cover 32 from below. Accordingly, the position of the IC board 64 relative to the contacts 106 can be fixed accurately. Here, the rod 125 may not necessarily support the front cover 32 from below. Alternatively, for example, some annular member may be provided around the ink needle 102 and contact the front cover 32 to support the front cover 32.

In the state shown in FIG. 10, the movable member 160 has arrived at the second position.

At this time, the light-blocking portion 66 comes to a position between the light-emitting portion and the light-receiving portion of the residual-amount sensor 103. Therefore, the signal outputted from the residual-amount sensor 103 to the controller 1 of the printer 10 is changed again from the high level to the low level, as indicated by an arrow "D" in FIG. 12A. On the other hand, since the movable member 160 is kept located between the light-emitting portion and the light-receiving portion of the attachment sensor 113, the attachment sensor 113 continues to output the low-level signal to the controller 1 of the printer 10, as indicated by the arrow "B" in FIG. 12B.

Moreover, in the state shown in FIG. 10, the engaging portion 130 is located vertically above the corresponding recess 91. That is, the contact member 131 is no longer supported by the bottom wall constituting the case 101 of the cartridge mounting portion 110. Accordingly, as illustrated in FIG. 11, the contact member 131 is moved downward by the biasing force of the coil spring 132 to be received in the recess 91. Here, since the ink cartridge 30 is biased rearward by the coil spring 78, the surface 134 of the contact member 131 comes into contact with the surface 93 of the recess 91 from its front side. That is, the surface 134 of the contact member 131 and the surface 93 defining the recess 91 engage each other. This engagement between the surface 134 and the surface 93 restricts the ink cartridge 30 from moving rearward due to the biasing force of the coil spring 78. That is, the ink cartridge 30 is fixed in position relative to the cartridge mounting portion 110. Attachment of the ink cartridge 30 to the cartridge mounting portion 110 is thus completed and the ink cartridge 30 is in the attached state.

In the attached state shown in FIG. 11, the abutment portion 120 (abutment surface 121) is in contact with the movable member 160 (front surface 164 of the rib 161), thereby maintaining the movable member 160 at the second position.

Next, a process for removing the ink cartridge 30 in the attached state from the cartridge mounting portion 110 will be described.

When the user grasps and pulls the ink cartridge 30 in the attached state (shown in FIG. 11) rearward, the surface 134 of the contact member 131 of the engaging portion 130 presses the surface 93 of the recess 91 of the cartridge mounting portion 110 rearward. Accordingly, the contact member 131 moves upward along the surface 93 against the biasing force of the coil spring 132 by a reaction force from the surface 93. As a result, as illustrated in FIG. 9, the contact member 131, which has moved upward, is then supported by the bottom wall constituting the case 101 of the cartridge mounting portion 110. That is, the rearward movement of the ink cartridge 30 is no longer restricted. The ink cartridge 30 is therefore allowed to move further rearward as the user withdraws the ink cartridge 30 rearward. The ink cartridge 30 is finally detached from the cartridge mounting portion 110.

When the ink cartridge 30 in the attached state is moved rearward, the rib 161 of the movable member 160 is also moved to a position rearward of the position between the light-emitting portion and the light-receiving portion of the attachment sensor 113. Accordingly, the signal outputted from the attachment sensor 113 to the controller 1 of the printer 10 is changed from the low level to the high level, thereby enabling the controller 1 to detect that the ink cartridge 30 is detached from the cartridge mounting portion 110.

In accordance with rearward movement of the ink cartridge 30, the movable member 160 is separated from the abutment portion 120. Accordingly, the movable member 160 is moved frontward relative to the main body (the rear cover 31, the front cover 32, and the inner frame 35) of the ink cartridge 30, against the urging force of the coil spring 163. The movable member 160 is thus moved back to the first position from the second position.

<Detection Performed by the Controller 1>

Figure 13:
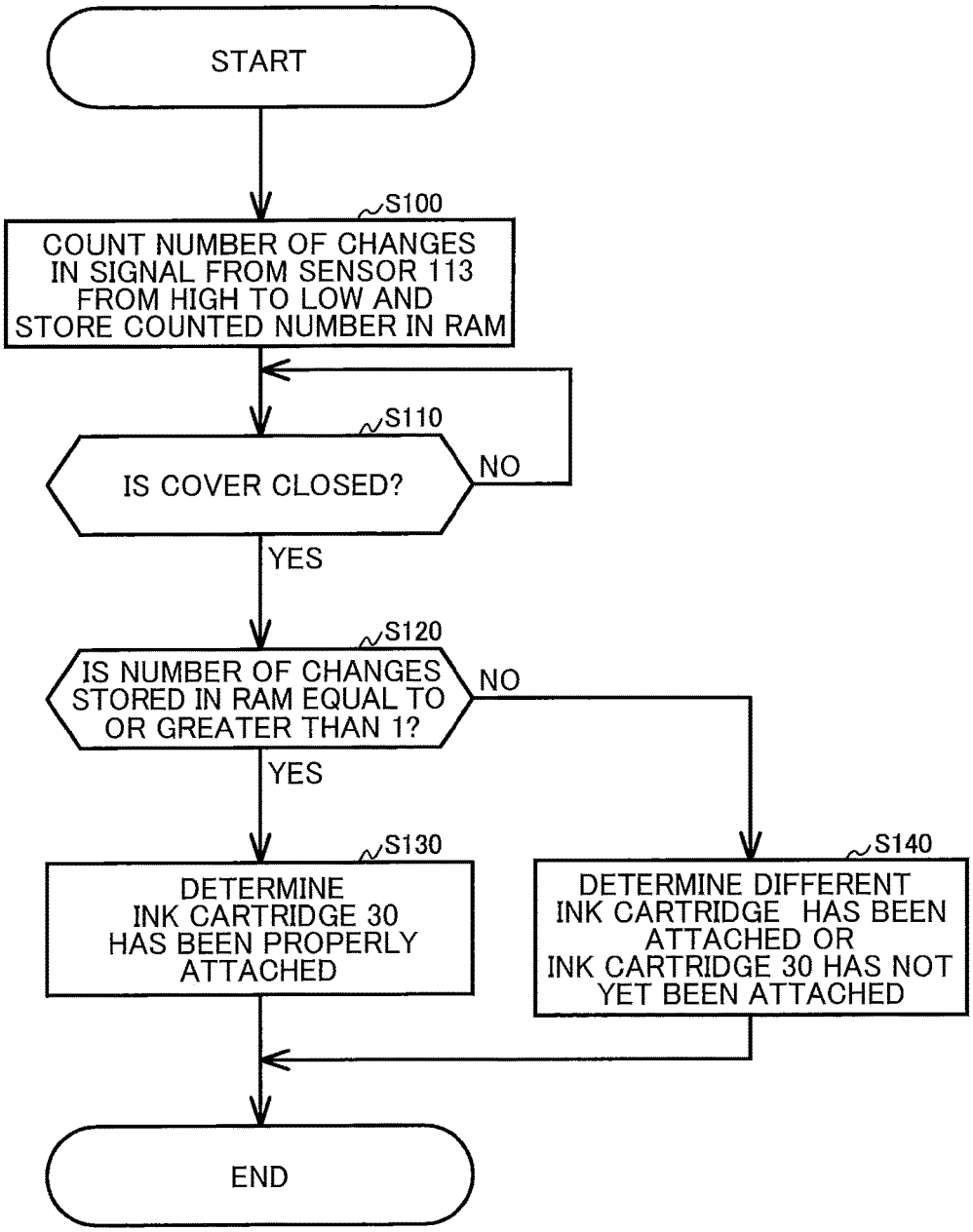
FIG. 13 is a flowchart of a process illustrating steps executed by the controller to determine whether the ink cartridge according to the embodiment is attached to the cartridge mounting portion.

Next, how the controller 1 detects attachment of the ink cartridge 30 to the cartridge mounting portion 110 will be described with reference to the flowchart of FIG. 13.

First, in S100, the controller 1 counts how many times the signal transmitted thereto from the attachment sensor 113 is changed from high level to low level since the cover of the cartridge mounting portion 110 was opened, until the cover of the cartridge mounting portion 110 is closed. The controller 1 also stores data indicative of the result of the counting in the RAM in S100.

The controller 1 then determines in S110 whether or not the cover of the cartridge mounting portion 110 is closed. The controller 1 determines that the cover of the cartridge mounting portion 110 is closed upon receipt of the detection signal from the cover sensor 118. The controller 1 repeats the process of S110 until detecting that the cover of the cartridge mounting portion 110 is closed (S110: NO). When the controller 1 determines in S110 that the cover of the cartridge mounting portion 110 is closed (S110: YES), in S120 the controller 1 refers to the data stored in the RAM (data indicating the number of times of changes in the signal from high to low in the attachment sensor 113).

When the number of times of changes is equal to or greater than 1 (S120: YES), the controller 1 determines in S130 that the ink cartridge 30 has been properly attached to the cartridge mounting portion 110. On the other hand, when the number of times of changes is zero (S120: NO), the controller 1 determines in S140 that: an ink cartridge different from the ink cartridge 30 is attached to the cartridge mounting portion 110; or the ink cartridge 30 is not yet attached to the cartridge mounting portion 110. If this is the case (if the process goes to S140), the controller 1 may issue a message prompting the user to attach the ink cartridge 30, for example.

Next, movement of the movable member 160 while the amount of ink left in the ink chamber 36 becomes smaller will be described with reference to FIG. 12C.

As illustrated in FIG. 11, when the residual amount of ink in the ink chamber 36 is sufficient, the light-blocking portion 66 of the sensor arm 59 is positioned between the light-emitting portion and light-receiving portion of the residual-amount sensor 103, thereby blocking the light from the light-emitting portion. Thus, the residual-amount sensor 103 continues to output a low level signal to the controller 1 of the printer 10, as indicated an arrow A in FIG. 12C, as long as the amount of ink in the ink chamber 36 is sufficient enough to maintain the light-blocking portion 66 at the detection position.

As the ink flows out from the ink cartridge 30 in the attached state to the print head 21 and the ink is consumed by the print head 21, the amount of ink stored in the ink chamber 36 becomes smaller. In accordance with reduction in the amount of ink left in the ink chamber 36, the part of the light-blocking portion 66, which was located in the housing 62, is caused to move rearward such that the light-blocking portion 66 is displaced to be offset from the optical path formed by the light traveling from the light-emitting portion to the light-receiving portion of the residual-amount sensor 103.

More specifically, as the ink stored in the ink chamber 36 is consumed from the state illustrated in FIG. 11 and the amount of ink left in the ink chamber 36 is reduced, the float 63 is moved downward following decline in liquid surface of the ink in the ink chamber 36, causing the sensor arm 59 to pivot clockwise in FIG. 11 to move the light-blocking portion 66 out of the position between the light-emitting portion and the light-receiving portion of the residual-amount sensor 103 (see the broken line in FIG. 7).

Since the light-blocking portion 66 is no longer located between the light-emitting portion and the light-receiving portion of the residual-amount sensor 103, the light-blocking portion 66 does not block the light emitted from the light-emitting portion of the residual-amount sensor 103. Thus, as indicated by an arrow "B" in FIG. 12C, the signal transmitted from the residual-amount sensor 103 to the controller 1 is changed from low level to high level. The controller 1 of the printer 10 therefore detects that the amount of ink left in the ink chamber 36 has decreased substantially, i.e., the residual amount of ink in the ink chamber 36 is smaller than a predetermined amount.

Operational and Technical Advantages of the Embodiment

In the ink cartridge 30 according to the embodiment, when the movable member 160 is in the first position, external contact to the IC board 64 from above and/or from frontward can be restricted. That is, the movable member 160 at the first position can provide protection to the IC board 64. This structure can reduce the likelihood that the IC board 64 is damaged or contaminated by being contacted by external objects.

Further, the movable member 160 according to the embodiment includes the rib 161. That is, the movable member 160 can function only to protect the IC board 64, but also to allow detection on the information on the ink cartridge 30.

In the depicted embodiment, the coil spring 163 can maintain the movable member 160 at the first position so that the movable member 160 can protect the IC board 64.

Further, the rib 161 can be detected from outside by light, without any external contact to the rib 161. This structure of the embodiment can prevent accidental displacement of the movable member 160 having the rib 161 due to external contact on the movable member 160.

Further, in the movable member 160 of the embodiment, a portion of the movable member 160 which serves to protect the IC board 64 (i.e., rib 161) also functions as a detection target to detect the information on the ink cartridge 30. This means that the movable member 160 can be made compact.

Further, in the depicted embodiment, the width of the movable member 160 in the right-left direction 55 and 56 (in the widthwise direction orthogonal to the insertion direction and the gravitational direction) is smaller than the width of the IC board 64 in the right-left direction 55 and 56.

Accordingly, the IC board 64 is visible from above when the movable member 160 is at the first position.

Variations and Modifications

Figure 14A:
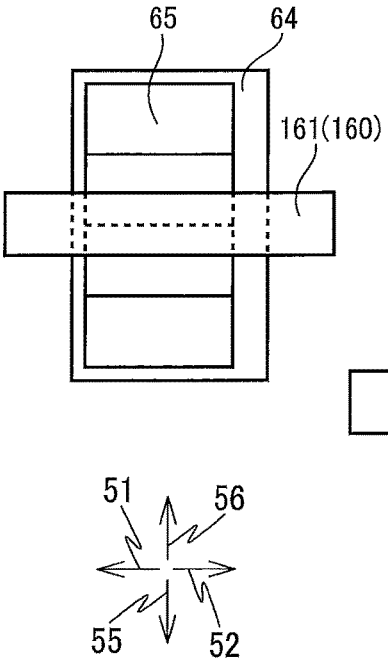
FIG. 14A is a schematic view illustrating a positional relationship between an IC board and the rib of the movable member at its first position according to the embodiment.
Figure 14B:
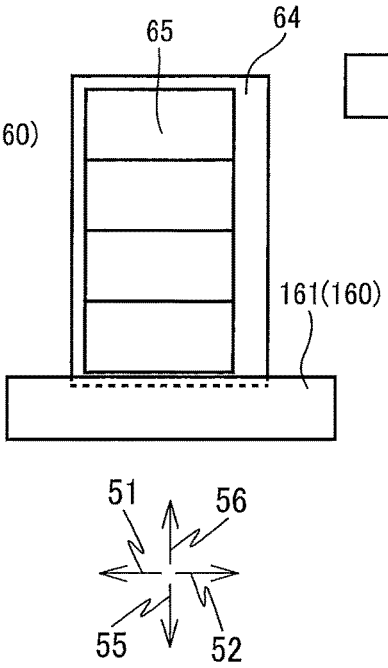
FIGS. 14B and 14C are schematic views illustrating variations of the positional relationship between the IC board and the movable member at its first position shown in FIG. 14A.
Figure 14C:
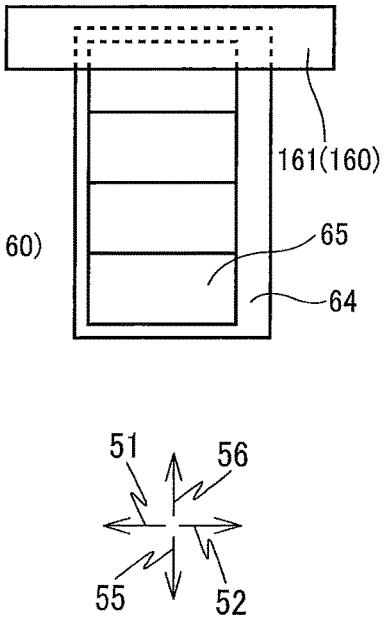

In the depicted embodiment, the rib 161 of the movable member 160 at the first position is disposed between the left and right edges of the IC board 64 in the right-left direction 55 and 56, as shown in FIG. 14A. However, the movable member 160 at the first position may not be arranged between the left and right edges of the IC board 64 in the right-left direction 55 and 56, provided that the movable member 160 at first position has at least a portion whose left-right position (widthwise position) coincides with the IC board 64 in the right-left direction 55 and 56. For example, the movable member 160 at the first position may be arranged such that the right edge thereof is located rightward relative to the right edge of the IC board 64, while the left edge of the movable member 160 is located between the right and left edges of the IC board 64 (see FIG. 14B). Alternatively, the movable member 160 at the first position may be arranged such that the left edge thereof is located leftward relative to the left edge of the IC board 64, while the right edge of the movable member 160 is located between the right and left edges of the IC board 64 (see FIG. 14C).

Further, in the embodiment, a portion of the movable member 160 at the first position (i.e., the rib 161) is located frontward and upward relative to the IC board 64, as shown in FIGS. 4A, 5A, 7 and 14A. However, a portion of the movable member 160 at the first position may be located either frontward or upward relative to the IC board 64, provided that the left-right position of the portion of the movable member 160 at the first position is coincident with the IC board 64 in the right-left direction 55 and 56. In other words, the portion of the movable member 160 at the first position may be located either: upward of the IC board 64 and overlapped with the IC board 64 when viewed from above; or frontward of the IC board 64 and overlapped with the IC board 64 when viewed frontward in the front-rear direction 51 and 52. Put another way, the movable member 160 at the first position may have a portion that is located either: upward of the IC board 64 and aligned with the IC board 64 in the up-down direction 53 and 54; or frontward of the IC board 64 and aligned with the IC board 64 in the front-rear direction 51 and 52. Here, "frontward" means "downstream in the insertion direction (frontward direction 51)". Accordingly, "rearward" means "upstream in the insertion direction (frontward direction 51)".

Figure 15A:
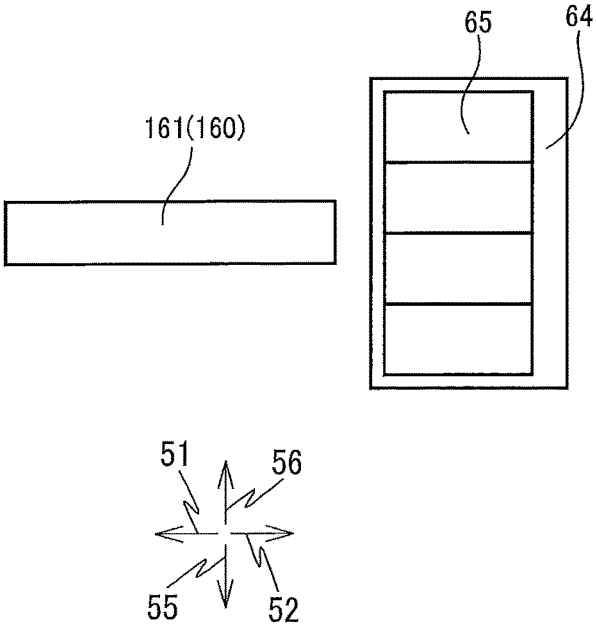
FIGS. 15A and 15B are schematic views illustrating further variations of the positional relationship between the IC board and the movable member at its first position shown in FIG. 14A.
Figure 15B:
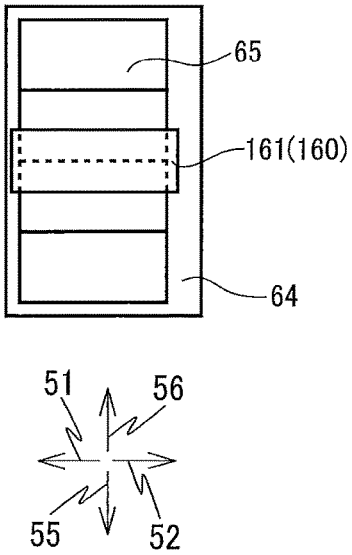

For example, an entirety of the movable member 160 at the first position may be located frontward relative to the IC board 64, while nothing may be located vertically above the movable member 160, as shown in FIG. 15A. Alternatively, an entirety of the movable member 160 at the first position may be located vertically above the IC board 64, while nothing may be located frontward of the IC board 64, as shown in FIG. 15B.

Further, in the depicted embodiment, as shown in FIG. 14A, when the movable member 160 is at the first position, a portion of the rib 161 (a portion near the front surface 164) is positioned frontward relative to the IC board 64, while another portion of the rib 161 (the center portion of the rib 161, that is, a portion different from the portion near the front surface 164) is located vertically above the IC board 64. However, when the movable member 160 is at the first position, the rib 161 in its entirety may be located frontward of the IC board 64, but not vertically above the IC board 64 (refer to FIG. 15A). Alternatively, as shown in FIG. 15B, when the movable member 160 is at the first position, the rib 161 in its entirety may be located vertically above the IC board 64, but not frontward of the IC board 64.

Further, in the embodiment described above, the front surface 164 of the rib 161 constituting the movable member 160 makes contact with the abutment surface 121 of the abutment portion 120 of the cartridge mounting portion 110, thereby moving the movable member 160 toward the second position from the first position. However, a portion of the movable member 160 other than the front surface 164 of the rib 161 may be configured to abut on the cartridge mounting portion 110 to move the movable member 160 from the first position to the second position. Likewise, a portion of the cartridge mounting portion 110 different from the abutment portion 120 may contact the movable member 160 to move the movable member 160 from the first position to the second position.

Figure 16:
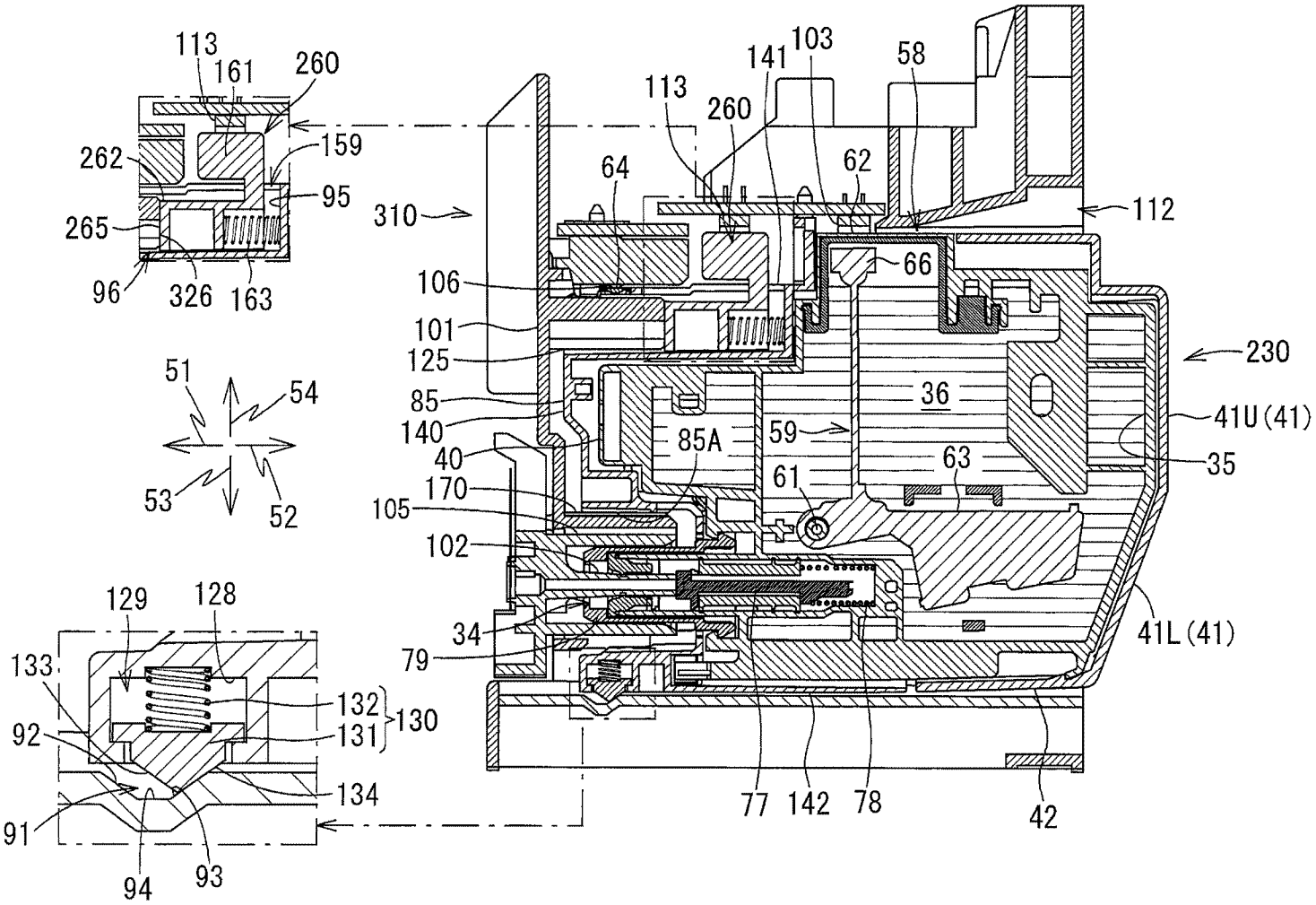
FIG. 16 is a vertical cross-sectional view illustrating an ink cartridge according to a modification to the embodiment and the cartridge mounting portion, and illustrating a state where: the ink needle is in the ink supply port of the ink supply portion; the engaging portion is engaged with the recess of the cartridge mounting portion; and a movable member according to the modification is at its second position.

For example, FIG. 16 shows an ink cartridge 230 according to a modification to the embodiment. The ink cartridge 230 is attachable to and detachable from a cartridge mounting portion 310 without the abutment portion 120. The ink cartridge 230 includes a movable member 260, instead of the movable member 160. The movable member 260 includes the rib 161, and a base portion 262 in place of the base portion 162. The base portion 262 constitutes a lower end portion of the movable member 260. The base portion 262 is located in the internal space 96A of the recessed portion 96. The base portion 262 extends in the front-rear direction 51 and 52 and has a front surface 265 that is positioned frontward relative to a front surface of the rib 161.

In this example shown in FIG. 16, during insertion of the ink cartridge 230 into the cartridge mounting portion 310, the front surface 265 of the base portion 262 is brought into abutment with a rear surface 326 of the rod 125 of the cartridge mounting portion 310, thereby moving the movable member 260 toward the second position from the first position. That is, the rear surface 326 is positioned downward relative to the IC board 64 of the ink cartridge 230 attached to the cartridge mounting portion 310. In this example, the front surface 265 is another example of the contact portion, the rod 125 is another example of the abutment portion, and the rear surface 326 of the rod 125 is an example of the abutment surface.

In this modification, the rod 125, which is configured to apply a force (external force) to the front surface 265 of the base portion 262, does not make contact with the IC board 64 from above to move the movable member 160 from the first position to the second position. Accordingly, this structure of the modification can prevent the IC board 64 from being damaged or contaminated by the rod 125.

Further, in the depicted embodiment, when the movable member 160 is at the second position, the rib 161 is located between the light-emitting portion and the light-receiving portion of the attachment sensor 113 as shown in FIG. 11, interrupting (block or attenuate) the light traveling in the right-left direction 55 and 56. However, alternatively, the rib 161 may be configured to block or attenuate the light coming from the residual-amount sensor 103, not from the attachment sensor 113.

Still further, in the depicted embodiment, reduction in the residual amount of ink in the ink chamber 36 can be detected by the sensor arm 59 pivoting within the ink chamber 36 to displace the light-blocking portion 66 of the sensor arm 59 from the path of the light traveling from the light-emitting portion to the light-receiving portion of the residual-amount sensor 103. However, detection of the residual amount of ink in the ink chamber 36 may be performed through a different configuration from the depicted embodiment.

For example, the ink cartridge 30 may not include the sensor arm 59. Instead, the housing 62 may have a prism shape so as to change (bend) a traveling direction of the light emitted from the light-emitting portion of the residual-amount sensor 103 depending on presence or absence of ink in the housing 62.

Alternatively, the ink cartridge 30 may include a light-emitting device, instead of the housing 62 and the sensor arm 59. The light-emitting device may incorporate a battery therein, and may be configured to emit light at a predetermined timing to notify the controller 1 that the amount of ink left in the ink chamber 36 becomes smaller. Here, the predetermined timing may be, for example, such a timing that a prescribed number of days, which are expected to be required to consume a predetermined amount of ink, have elapsed since power is supplied to the printer 10 for the first time.

Still further, the IC board 64 may be a flexible substrate formed of a plastic film and having flexibility, instead of the plate-shaped rigid board.

Still further, in the above-described embodiment, the coil spring 78 of the ink supply portion 34 functions to urge the ink cartridge 30 attached to the cartridge mounting portion 110 rearward. However, a different structure from the depicted configuration may be employed for urging the ink cartridge 30 attached to the cartridge mounting portion 110 rearward.

For example, a spring for biasing the ink cartridge 30 rearward may be provided at a position other than the ink supply portion 34. For example, the coil spring 163 disposed in the recessed portion 96 may also serve to urge the attached ink cartridge 30 rearward.

In the above-described embodiment, the rib 161 of the movable member 160 is configured to block the light of the attachment sensor 113 for the purpose of detecting whether or not the ink cartridge 30 is attached to the cartridge mounting portion 110. However, the rib 161 may be provided for a different purpose. For example, the rib 161 may be provided to identify a type of the ink cartridge 30 (such as a color of stored ink, and a type of stored ink) attached to the cartridge mounting portion 110.

For example, assume that the rib 161 of the movable member 160 is used to identify the color of the ink cartridge 30 attached to the cartridge mounting portion 110. Specifically, assume that there are two kinds of ink cartridges 30, i.e., an ink cartridge 30 storing ink of a black color, and another ink cartridge 30 storing ink of a color other than black. The ink cartridge 30 storing ink of a black color may be provided with the rib 161 of the embodiment. The other ink cartridge 30 storing ink of a color other than black may be provided with a different rib 161 that is formed with a through-hole therein. That is, the light emitted from the light-emitting portion of the attachment sensor 113 is allowed to pass through the through-hole of the rib 161. With this structure, during the insertion of the ink cartridge 30 into the cartridge mounting portion 110, the number of changes in signal outputted from the attachment sensor 113 between high level and low level may vary depending on whether or not the rib 161 is formed with the through-hole. Accordingly, the controller 1 can determine the type of the ink cartridge 30 (color of the ink cartridge 30) attached to the cartridge mounting portion 110, based on the counted number of changes in signal outputted from the attachment sensor 113 in S120 in the flowchart of FIG. 13.

Figure 12B:
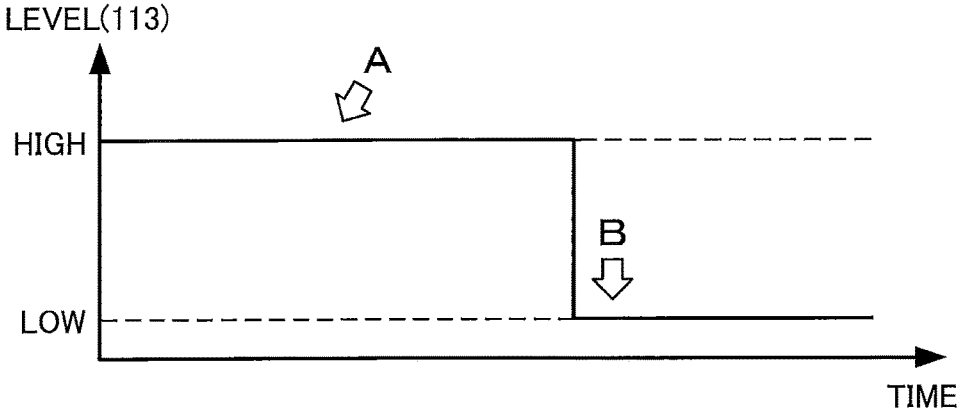
FIG. 12B is a timing chart illustrating changes in signal outputted from an attachment sensor during the process in which the ink cartridge according to the embodiment is attached to the cartridge mounting portion.
Figure 12C:
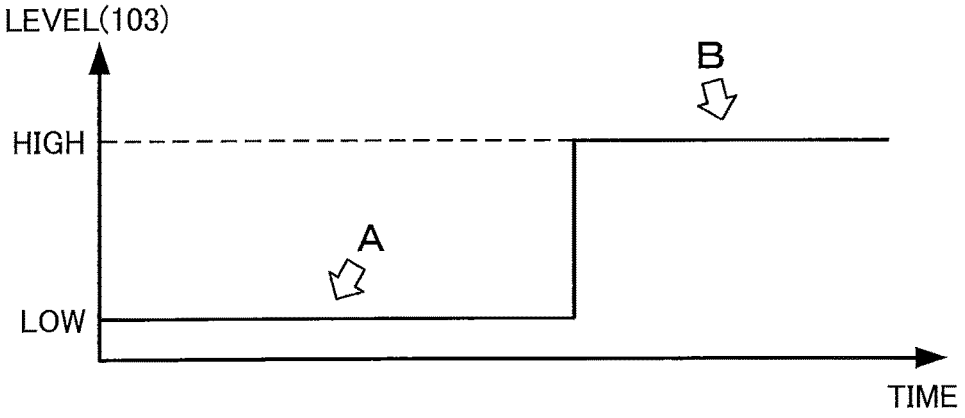
FIG. 12C is a timing chart illustrating a change in the signal outputted from the residual-amount sensor as ink stored in the ink cartridge according to the embodiment is being consumed after attachment to the cartridge mounting portion.

More specifically, if the ink cartridge 30 having the rib 161 without a through-hole is inserted into the cartridge mounting portion 110, the signal outputted from the attachment sensor 113 may change once from high level to low level during the insertion of the ink cartridge 30 into the cartridge mounting portion 110, as shown in FIG. 12B. Accordingly, the controller 1 can determine in S120 that the ink cartridge 30 of black color (ink cartridge 30K) is attached to the cartridge mounting portion 110 if there is only one change in the signal from the attachment sensor 113. If the rib 161 is formed with a through-hole, the signal outputted from the attachment sensor 113 may change from high level to low level, then to high level again, and finally to low level. That is, the signal outputted from the attachment sensor 113 may change from high to low more than once (at least twice) during the insertion of the ink cartridge 30 into the cartridge mounting portion 110. The controller 1 may therefore determine that the ink cartridge 30 of a color different from black is attached to the cartridge mounting portion 110 if the signal outputted from the attachment sensor 113 is changed more than once.

While ink serves as an example of the liquid in the depicted embodiment, the liquid of the present disclosure is not limited to ink. For example, a pretreatment liquid that can be ejected onto sheets prior to ink during a printing operation may be stored in the liquid cartridge. Alternatively, cleaning water for cleaning the print head 21 may be stored in the liquid cartridge.

While the disclosure is described in detail with reference to the specific embodiment thereof while referring to accompanying drawings, it would be apparent to those skilled in the art that many modifications and variations may be made therein without departing from the scope of the disclosure.

What is claimed is:

1. A liquid cartridge configured to store liquid therein and configured to be inserted into a cartridge mounting portion in an insertion direction intersecting a gravitational direction in an upright posture, the liquid cartridge comprising:

a front surface facing in the insertion direction in the upright posture;

a rear surface spaced apart from the front surface in the insertion direction in the upright posture;

an upper surface extending between the front surface and the rear surface in the insertion direction in the upright posture, the upper surface facing upward in the upright posture;

a liquid supply portion disposed at the front surface and configured to supply the liquid to outside of the liquid cartridge;

an electrical interface disposed at the upper surface, the electrical interface having a width in a widthwise direction orthogonal to the insertion direction and the gravitational direction;

a movable member including a detection portion subject to external detection, the movable member being movable between a first position and a second position, the second position being located upstream in the insertion direction relative to the first position, the movable member at the second position being positioned upstream in the insertion direction relative to the electrical interface, the movable member at the first position having a portion whose widthwise position is coincident with the electrical interface in the widthwise direction, the portion of the movable member at the first position being located downstream in the insertion direction or upward relative to the electrical interface;

wherein the movable member comprises a rib extending to protrude upward relative to the upper surface; and wherein the rib comprises the detection portion.

2. The liquid cartridge as claimed in claim 1, wherein the portion of the movable member at the first position is located downstream in the insertion direction and upward relative to the electrical interface.

3. The liquid cartridge as claimed in claim 1, wherein the movable member includes a contact portion configured to be applied with an external force, the movable member moving from the first position to the second position upon application of the external force at the contact portion.

4. The liquid cartridge as claimed in claim 3, wherein the contact portion constitutes a front end portion of the movable member and faces in the insertion direction.

5. The liquid cartridge as claimed in claim 3, further comprising a recessed portion arranged downward relative to the electrical interface, the recessed portion defining an opening facing in the insertion direction and an internal space in communication with ambient air through the opening, the contact portion being located in the internal space of the recessed portion.

6. The liquid cartridge as claimed in claim 5, wherein the detection portion of the movable member is arranged upward relative to the recessed portion.

7. The liquid cartridge as claimed in claim 1, further comprising an urging member configured to urge the movable member toward the first position.

8. The liquid cartridge as claimed in claim 1, wherein the movable member moves from the first position to the second position upon application of an external force to the rib.

9. The liquid cartridge as claimed in claim 1, wherein the detection portion extends in the insertion direction and is configured to block or attenuate light traveling in the widthwise direction.

10. The liquid cartridge as claimed in claim 1, wherein the detection portion of the movable member at the first position is positioned downstream in the insertion direction or upward relative to the electrical interface.

11. The liquid cartridge as claimed in claim 1, wherein the detection portion of the movable member at the first position is positioned downstream in the insertion direction and upward relative to the electrical interface.

12. The liquid cartridge as claimed in claim 1, wherein the movable member has a width in the widthwise direction that is smaller than the width of the electrical interface in the width direction.

13. The liquid cartridge as claimed in claim 1, wherein an entirety of the movable member is movable in the insertion direction and in a removal direction opposite to the insertion direction.

14. A liquid-consuming device comprising:

a liquid cartridge configured to store liquid therein and configured to be inserted in an insertion direction intersecting a gravitational direction in an upright posture, comprising:

a front surface facing in the insertion direction in the upright posture;

a rear surface spaced apart from the front surface in the insertion direction in the upright posture;

an upper surface extending between the front surface and the rear surface in the insertion direction in the upright posture, the upper surface facing upward in the upright posture;

a liquid supply portion disposed at the front surface and configured to supply the liquid to outside of the liquid cartridge;

an electrical interface disposed at the upper surface, the electrical interface having a width in a widthwise direction orthogonal to the insertion direction and the gravitational direction, the electrical interface including an electrode; and a movable member including a detection portion subject to external detection, the movable member being movable between a first position and a second position, the second position being located upstream in the insertion direction relative to the first position, the movable member at the second position being positioned upstream in the insertion direction relative to the electrical interface, the movable member at the first position having a portion whose widthwise position is coincident with the electrical interface in the widthwise direction, the portion of the movable member at the first position being located downstream in the insertion direction or upward relative to the electrical interface;

a cartridge mounting portion, the liquid cartridge being configured to be inserted into the cartridge mounting portion in the insertion direction and removed from the cartridge mounting portion in a removal direction opposite to the insertion direction, the cartridge mounting portion comprising:

a case defining an inner space for accommodating the liquid cartridge therein;

a contact disposed at the case, the contact being configured to be electrically connected to the electrode of the electrical interface when the liquid cartridge is attached to the case;

a sensor including a light-emitting portion and a light-receiving portion positioned opposite to each other in the widthwise direction, the detection portion of the liquid cartridge attached to the case being configured to be interposed between the light-emitting portion and the light-receiving portion in the widthwise direction; and an abutment portion disposed at the case and configured to abut on the movable member of the liquid cartridge attached to the case and maintain the movable member at the second position;

a consuming section configured to consume the liquid stored in the liquid cartridge when the liquid cartridge is attached to the case of the cartridge mounting portion;

wherein the movable member comprises a rib extending to protrude upward relative to the upper surface; and wherein the rib comprises the detection portion.

15. The liquid-consuming device as claimed in claim 14, wherein the abutment portion comprises an abutment surface facing upstream in the insertion direction and exposed to the inner space of the case, the abutment surface being configured to abut on the movable member during insertion of the liquid cartridge into the case of the cartridge mounting portion.

16. The liquid-consuming device as claimed in claim 15, wherein the abutment surface is positioned upward relative to the electrical interface of the liquid cartridge attached to the case of the cartridge mounting portion.

17. The liquid-consuming device as claimed in claim 15, wherein the abutment surface is positioned downward relative to the electrical interface of the liquid cartridge attached to the case of the cartridge mounting portion.

18. The liquid-consuming device as claimed in claim 15, wherein the contact protrudes from the case toward the inner space of the case and is configured to engage the electrode of the electrical interface of the liquid cartridge attached to the case of the cartridge mounting portion, wherein the contact is disposed downstream relative to the sensor in the insertion direction, and wherein the abutment surface is positioned between the contact and the sensor in the insertion direction.

* * * * *